US008013813B2

(12) United States Patent
Ono

(10) Patent No.: US 8,013,813 B2
(45) Date of Patent: Sep. 6, 2011

(54) ACTIVE MATRIX-TYPE DISPLAY DEVICE

(75) Inventor: Shinya Ono, Yokohama (JP)

(73) Assignee: Global OLED Technology LLC, Herndon, VA (US)

( * ) Notice: Subject to any disclaimer, the term of this patent is extended or adjusted under 35 U.S.C. 154(b) by 743 days.

(21) Appl. No.: 12/064,091

(22) PCT Filed: Aug. 24, 2006

(86) PCT No.: PCT/US2006/033314

§ 371 (c)(1),
(2), (4) Date: Jun. 24, 2008

(87) PCT Pub. No.: WO2007/027534

PCT Pub. Date: Mar. 8, 2007

(65) Prior Publication Data

US 2009/0015522 A1 Jan. 15, 2009

(30) Foreign Application Priority Data

Aug. 30, 2005 (JP) ..... 2005-250303

(51) Int. Cl.
*G09G 3/30* (2006.01)

(52) U.S. Cl. ..... 345/76; 345/77; 315/100

(58) Field of Classification Search ..... 345/76, 345/77; 315/100

See application file for complete search history.

(56) References Cited

U.S. PATENT DOCUMENTS

| | | | | |
|---|---|---|---|---|
| 2002/0047852 | A1 | 4/2002 | Inukai et al. | |
| 2004/0066359 | A1 * | 4/2004 | Okuda | 345/76 |
| 2004/0239599 | A1 * | 12/2004 | Koyama | 345/76 |
| 2005/0110723 | A1 * | 5/2005 | Shin | 345/76 |
| 2005/0212408 | A1 * | 9/2005 | Yoshida et al. | 313/503 |
| 2006/0044229 | A1 * | 3/2006 | Yamazaki et al. | 345/76 |
| 2006/0077138 | A1 * | 4/2006 | Kim | 345/76 |
| 2006/0119554 | A1 * | 6/2006 | Kawae | 345/77 |
| 2006/0220572 | A1 * | 10/2006 | Seki | 315/100 |
| 2007/0103405 | A1 * | 5/2007 | Kwak et al. | 345/76 |

FOREIGN PATENT DOCUMENTS

| | | |
|---|---|---|
| EP | 0895219 | 2/1999 |
| JP | 10-214060 | 8/1998 |
| JP | 11-338402 | 12/1999 |
| JP | 2003-223136 | 8/2003 |
| JP | 2003-223137 | 8/2003 |
| JP | 2005-31643 | 2/2005 |
| WO | 2006/012028 | 2/2006 |

OTHER PUBLICATIONS

H. Kageyama et al, 51:1: A 2.5 inch OLED Display with a Three-TFT Pixel Circuit for Clamped Inverter Driving, SID 04 Digest, pp. 1394-1397, 2004.

* cited by examiner

*Primary Examiner* — Amare Mengistu
*Assistant Examiner* — Premal Patel
(74) *Attorney, Agent, or Firm* — Morgan, Lewis & Bockius LLP

(57) ABSTRACT

When performing gradation expression using a time division driving method, an operational frequency of a driving circuit is suppressed, and non-light emitting time is eliminated to increase the light emitting time. Each of a number of pixel circuits includes a light emitting element, a driver element for turning on or off a driving current of the light emitting element, a switching element for controlling connection of a gate electrode of the driver element with a signal line, and a capacitance to which a signal voltage supplied from the signal line to the gate electrode of the driver element is written.

8 Claims, 27 Drawing Sheets

| SIGNAL VOLTAGE\ SECOND SCANNING LINE | $V_L$ (STATE A) | $V_H$ (STATE B) |
|---|---|---|
| $V_0$ | OFF | OFF |
| $V_0-V_{D1}$ | ON | OFF |
| $V_0-V_{D1}-V_{D2}$ | ON | ON |

$$V_{DD}-V_0<V_t$$
$$V_{DD}-(V_0-V_{D1})>V_t$$
$$V_{DD}-(V_0-V_{D1})-(V_H-V_L)<V_t$$
$$V_{DD}-(V_0-V_{D1}-V_{D2})-(V_H-V_L)>V_t$$

*FIG. 5*

[1] LIGHT EMITTING PERIOD
[0] NON-LIGHT EMITTING PERIOD
[ ] NON-PRIORITY LIGHT EMITTING SUB-SUBFRAME

| | SUBFRAME 1 | | SUBFRAME 2 | | SUBFRAME 3 | | SUBFRAME 4 | | SUBFRAME 5 | | SUBFRAME 6 | |
|---|---|---|---|---|---|---|---|---|---|---|---|---|
| LENGTH OF SUBFRAME | 11 | | 11 | | 11 | | 10 | | 10 | | 10 | |
| NUMBER OF SUB-SUBFRAME | 1 | 2 | 3 | 4 | 5 | 6 | 7 | 8 | 9 | 10 | 11 | 12 |
| LENGTH OF SUB-SUBFRAME | 10 | 1 | 9 | 2 | ? | 4 | 6 | 4 | 8 | 2 | 9 | 1 |
| GRADATION 0 | 0 | 0 | 0 | 0 | 0 | 0 | 0 | 0 | 0 | 0 | 0 | 0 |
| 1 | 0 | 1 | 0 | 0 | 0 | 0 | 0 | 0 | 0 | 0 | 0 | 0 |
| 2 | 0 | 0 | 0 | 1 | 0 | 0 | 0 | 0 | 0 | 0 | 0 | 0 |
| 3 | 0 | 1 | 0 | 1 | 0 | 0 | 0 | 0 | 0 | 0 | 0 | 0 |
| 4 | 0 | 0 | 0 | 0 | 0 | 1 | 0 | 0 | 0 | 0 | 0 | 0 |
| 5 | 0 | 1 | 0 | 0 | 0 | 1 | 0 | 0 | 0 | 0 | 0 | 0 |
| 6 | 0 | 0 | 0 | 0 | 0 | 0 | 1 | 0 | 0 | 0 | 0 | 0 |
| 7 | 0 | 1 | 0 | 0 | 0 | 0 | 1 | 0 | 0 | 0 | 0 | 0 |
| 8 | 0 | 0 | 0 | 1 | 0 | 0 | 1 | 0 | 0 | 0 | 0 | 0 |
| 9 | 0 | 1 | 0 | 1 | 0 | 0 | 1 | 0 | 0 | 0 | 0 | 0 |
| 10 | 0 | 0 | 0 | 0 | 0 | 1 | 1 | 0 | 0 | 0 | 0 | 0 |
| 11 | 0 | 1 | 0 | 0 | 0 | 1 | 1 | 0 | 0 | 0 | 0 | 0 |
| 12 | 0 | 0 | 0 | 1 | 0 | 1 | 1 | 0 | 0 | 0 | 0 | 0 |
| 13 | 0 | 1 | 0 | 1 | 0 | 1 | 1 | 0 | 0 | 0 | 0 | 0 |
| 14 | 0 | 0 | 0 | 0 | 0 | 1 | 1 | 1 | 0 | 0 | 0 | 0 |
| 15 | 0 | 1 | 0 | 0 | 0 | 1 | 1 | 1 | 0 | 0 | 0 | 0 |
| 16 | 0 | 0 | 0 | 1 | 0 | 1 | 1 | 1 | 0 | 0 | 0 | 0 |
| 17 | 0 | 1 | 0 | 1 | 0 | 1 | 1 | 1 | 0 | 0 | 0 | 0 |
| 18 | 0 | 0 | 0 | 0 | 0 | 0 | 1 | 1 | 1 | 0 | 0 | 0 |
| 19 | 0 | 1 | 0 | 0 | 0 | 0 | 1 | 1 | 1 | 0 | 0 | 0 |
| 20 | 0 | 0 | 0 | 1 | 0 | 0 | 1 | 1 | 1 | 0 | 0 | 0 |
| 21 | 0 | 1 | 0 | 1 | 0 | 0 | 1 | 1 | 1 | 0 | 0 | 0 |
| 22 | 0 | 0 | 0 | 0 | 0 | 1 | 1 | 1 | 1 | 0 | 0 | 0 |
| 23 | 0 | 1 | 0 | 0 | 0 | 1 | 1 | 1 | 1 | 0 | 0 | 0 |
| 24 | 0 | 0 | 0 | 0 | 0 | 1 | 1 | 1 | 1 | 1 | 0 | 0 |
| 25 | 0 | 1 | 0 | 0 | 0 | 1 | 1 | 1 | 1 | 1 | 0 | 0 |
| 26 | 0 | 0 | 0 | 1 | 0 | 1 | 1 | 1 | 1 | 1 | 0 | 0 |
| 27 | 0 | 1 | 0 | 1 | 0 | 1 | 1 | 1 | 1 | 1 | 0 | 0 |
| 28 | 0 | 0 | 0 | 0 | 0 | 1 | 1 | 0 | 1 | 0 | 1 | 1 |
| 29 | 0 | 1 | 0 | 0 | 0 | 1 | 1 | 0 | 1 | 0 | 1 | 1 |
| 30 | 0 | 0 | 0 | 0 | 0 | 1 | 1 | 0 | 1 | 1 | 1 | 1 |
| 31 | 0 | 0 | 0 | 0 | 0 | 1 | 1 | 1 | 1 | 0 | 1 | 0 |
| 32 | 0 | 0 | 0 | 0 | 0 | 1 | 1 | 1 | 1 | 0 | 1 | 1 |
| 33 | 0 | 0 | 0 | 0 | 0 | 1 | 1 | 1 | 1 | 1 | 1 | 0 |
| 34 | 0 | 0 | 0 | 0 | 0 | 1 | 1 | 1 | 1 | 1 | 1 | 1 |
| 35 | 0 | 0 | 0 | 0 | 1 | 1 | 1 | 0 | 1 | 0 | 1 | 1 |
| 36 | 0 | 0 | 0 | 0 | 1 | 1 | 1 | 0 | 1 | 1 | 1 | 0 |
| 37 | 0 | 0 | 0 | 0 | 1 | 1 | 1 | 0 | 1 | 1 | 1 | 1 |
| 38 | 0 | 0 | 0 | 0 | 1 | 1 | 1 | 1 | 1 | 0 | 1 | 0 |
| 39 | 0 | 0 | 0 | 0 | 1 | 1 | 1 | 1 | 1 | 0 | 1 | 1 |
| 40 | 0 | 0 | 0 | 0 | 1 | 1 | 1 | 1 | 1 | 1 | 1 | 0 |
| 41 | 0 | 0 | 0 | 0 | 1 | 1 | 1 | 1 | 1 | 1 | 1 | 1 |
| 42 | 0 | 0 | 1 | 1 | 0 | 1 | 1 | 1 | 1 | 0 | 1 | 0 |
| 43 | 0 | 0 | 1 | 1 | 0 | 1 | 1 | 1 | 1 | 0 | 1 | 1 |
| 44 | 0 | 0 | 1 | 1 | 0 | 1 | 1 | 1 | 1 | 1 | 1 | 0 |
| 45 | 0 | 0 | 1 | 1 | 1 | 1 | 1 | 0 | 1 | 0 | 1 | 0 |
| 46 | 0 | 0 | 1 | 1 | 1 | 1 | 1 | 0 | 1 | 0 | 1 | 1 |
| 47 | 0 | 0 | 1 | 1 | 1 | 1 | 1 | 0 | 1 | 1 | 1 | 0 |
| 48 | 0 | 0 | 1 | 1 | 1 | 1 | 1 | 0 | 1 | 1 | 1 | 1 |
| 49 | 0 | 0 | 1 | 1 | 1 | 1 | 1 | 1 | 1 | 0 | 1 | 0 |
| 50 | 0 | 0 | 1 | 1 | 1 | 1 | 1 | 1 | 1 | 0 | 1 | 1 |
| 51 | 0 | 0 | 1 | 1 | 1 | 1 | 1 | 1 | 1 | 1 | 1 | 0 |
| 52 | 0 | 0 | 1 | 1 | 1 | 1 | 1 | 1 | 1 | 1 | 1 | 1 |
| 53 | 1 | 1 | 1 | 1 | 0 | 1 | 1 | 1 | 1 | 0 | 1 | 0 |
| 54 | 1 | 1 | 1 | 1 | 0 | 1 | 1 | 1 | 1 | 0 | 1 | 1 |
| 55 | 1 | 1 | 1 | 1 | 0 | 1 | 1 | 1 | 1 | 1 | 1 | 0 |
| 56 | 1 | 1 | 1 | 1 | 0 | 1 | 1 | 1 | 1 | 1 | 1 | 1 |
| 57 | 1 | 1 | 1 | 1 | 1 | 1 | 1 | 0 | 1 | 0 | 1 | 1 |
| 58 | 1 | 1 | 1 | 1 | 1 | 1 | 1 | 0 | 1 | 1 | 1 | 0 |
| 59 | 1 | 1 | 1 | 1 | 1 | 1 | 1 | 0 | 1 | 1 | 1 | 1 |
| 60 | 1 | 1 | 1 | 1 | 1 | 1 | 1 | 1 | 1 | 0 | 1 | 0 |
| 61 | 1 | 1 | 1 | 1 | 1 | 1 | 1 | 1 | 1 | 0 | 1 | 1 |
| 62 | 1 | 1 | 1 | 1 | 1 | 1 | 1 | 1 | 1 | 1 | 1 | 0 |
| 63 | 1 | 1 | 1 | 1 | 1 | 1 | 1 | 1 | 1 | 1 | 1 | 1 |

FIG. 7C

[1] LIGHT EMITTING PERIOD
[0] NON-LIGHT EMITTING PERIOD
[ ] NON-PRIORITY LIGHT EMITTING SUB-SUBFRAME

| | SUBFRAME 1 | | SUBFRAME 2 | | SUBFRAME 3 | | SUBFRAME 4 | | SUBFRAME 5 | | SUBFRAME 6 | |
|---|---|---|---|---|---|---|---|---|---|---|---|---|
| LENGTH OF SUBFRAME | 11 | | 11 | | 11 | | 11 | | 11 | | 11 | |
| NUMBER OF SUB-SUBFRAME | 1 | 2 | 3 | 4 | 5 | 6 | 7 | 8 | 9 | 10 | 11 | 12 |
| LENGTH OF SUB-SUBFRAME | 10 | 1 | 9 | 2 | ? | 4 | 7 | 4 | 9 | 2 | 10 | 1 |
| GRADATION 0 | 0 | 0 | 0 | 0 | 0 | 0 | 0 | 0 | 0 | 0 | 0 | 0 |
| 1 | 0 | [1] | 0 | 0 | 0 | 0 | 0 | 0 | 0 | 0 | 0 | 0 |
| 2 | 0 | 0 | 0 | [1] | 0 | 0 | 0 | 0 | 0 | 0 | 0 | 0 |
| 3 | 0 | [1] | 0 | [1] | 0 | 0 | 0 | 0 | 0 | 0 | 0 | 0 |
| 4 | 0 | 0 | 0 | 0 | 0 | [1] | 0 | 0 | 0 | 0 | 0 | 0 |
| 5 | 0 | [1] | 0 | 0 | 0 | [1] | 0 | 0 | 0 | 0 | 0 | 0 |
| 6 | 0 | 0 | 0 | [1] | 0 | [1] | 0 | 0 | 0 | 0 | 0 | 0 |
| 7 | 0 | 0 | 0 | 0 | 0 | 0 | 1 | 0 | 0 | 0 | 0 | 0 |
| 8 | 0 | [1] | 0 | 0 | 0 | 0 | 1 | 0 | 0 | 0 | 0 | 0 |
| 9 | 0 | 0 | 0 | [1] | 0 | 0 | 1 | 0 | 0 | 0 | 0 | 0 |
| 10 | 0 | [1] | 0 | [1] | 0 | 0 | 1 | 0 | 0 | 0 | 0 | 0 |
| 11 | 0 | 0 | 0 | 0 | 0 | 1 | 1 | 0 | 0 | 0 | 0 | 0 |
| 12 | 0 | [1] | 0 | 0 | 0 | 1 | 1 | 0 | 0 | 0 | 0 | 0 |
| 13 | 0 | 0 | 0 | [1] | 0 | 1 | 1 | 0 | 0 | 0 | 0 | 0 |
| 14 | 0 | [1] | 0 | [1] | 0 | 1 | 1 | 1 | 0 | 0 | 0 | 0 |
| 15 | 0 | 0 | 0 | 0 | 0 | 1 | 1 | 1 | 0 | 0 | 0 | 0 |
| 16 | 0 | [1] | 0 | 0 | 0 | 1 | 1 | 1 | 0 | 0 | 0 | 0 |
| 17 | 0 | 0 | 0 | [1] | 0 | 1 | 1 | 1 | 0 | 0 | 0 | 0 |
| 18 | 0 | 0 | 0 | 0 | 1 | 1 | 1 | 0 | 0 | 0 | 0 | 0 |
| 19 | 0 | [1] | 0 | 0 | 1 | 1 | 1 | 0 | 0 | 0 | 0 | 0 |
| 20 | 0 | 0 | 0 | [1] | 1 | 1 | 1 | 0 | 0 | 0 | 0 | 0 |
| 21 | 0 | [1] | 0 | [1] | 1 | 1 | 1 | 0 | 0 | 0 | 0 | 0 |
| 22 | 0 | 0 | 0 | 0 | 1 | 1 | 1 | 1 | 0 | 0 | 0 | 0 |
| 23 | 0 | [1] | 0 | 0 | 1 | 1 | 1 | 1 | 0 | 0 | 0 | 0 |
| 24 | 0 | 0 | 0 | [1] | 1 | 1 | 1 | 1 | 0 | 0 | 0 | 0 |
| 25 | 0 | [1] | 0 | [1] | 1 | 1 | 1 | 1 | 0 | 0 | 0 | 0 |
| 26 | 0 | 0 | 0 | [1] | 0 | 1 | 1 | 1 | 1 | 0 | 0 | 0 |
| 27 | 0 | 0 | 0 | 0 | 1 | 1 | 1 | 0 | 1 | 0 | 0 | 0 |
| 28 | 0 | [1] | 0 | 0 | 1 | 1 | 1 | 0 | 1 | 0 | 0 | 0 |
| 29 | 0 | 0 | 0 | [1] | 1 | 1 | 1 | 0 | 1 | 0 | 0 | 0 |
| 30 | 0 | [1] | 0 | [1] | 1 | 1 | 1 | 0 | 1 | 0 | 0 | 0 |
| 31 | 0 | 0 | 0 | 0 | 1 | 1 | 1 | 1 | 1 | 0 | 0 | 0 |
| 32 | 0 | [1] | 0 | 0 | 1 | 1 | 1 | 1 | 1 | 0 | 0 | 0 |
| 33 | 0 | 0 | 0 | 1 | 1 | 1 | 1 | 1 | 1 | 0 | 0 | 0 |
| 34 | 0 | [1] | 0 | 1 | 1 | 1 | 1 | 1 | 1 | 0 | 0 | 0 |
| 35 | 0 | 0 | 0 | 1 | 1 | 1 | 1 | 1 | 1 | 1 | 0 | 0 |
| 36 | 0 | [1] | 0 | 1 | 1 | 1 | 1 | 1 | 1 | 1 | 0 | 0 |
| 37 | 0 | 0 | 1 | 1 | 0 | 1 | 1 | 1 | 1 | 1 | 0 | 0 |
| 38 | 0 | 1 | 1 | 1 | 0 | 1 | 1 | 1 | 1 | 1 | 0 | 0 |
| 39 | 0 | 1 | 1 | 1 | 1 | 1 | 1 | 0 | 1 | 0 | 0 | 0 |
| 40 | 0 | 0 | 1 | 1 | 1 | 1 | 1 | 0 | 1 | 1 | 0 | 0 |
| 41 | 0 | 1 | 1 | 1 | 1 | 1 | 1 | 0 | 1 | 1 | 0 | 0 |
| 42 | 0 | 0 | 1 | 1 | 1 | 1 | 1 | 1 | 1 | 0 | 0 | 0 |
| 43 | 0 | 1 | 1 | 1 | 1 | 1 | 1 | 1 | 1 | 0 | 0 | 0 |
| 44 | 0 | 0 | 1 | 1 | 1 | 1 | 1 | 1 | 1 | 1 | 0 | 0 |
| 45 | 0 | 1 | 1 | 1 | 1 | 1 | 1 | 1 | 1 | 1 | 0 | 0 |
| 46 | 0 | 1 | 1 | 1 | 0 | 1 | 1 | 1 | 1 | 0 | 1 | 0 |
| 47 | 0 | 0 | 1 | 1 | 0 | 1 | 1 | 1 | 1 | 1 | 1 | 0 |
| 48 | 0 | 0 | 1 | 1 | 1 | 1 | 1 | 0 | 1 | 0 | 1 | 0 |
| 49 | 0 | 1 | 1 | 1 | 1 | 1 | 1 | 0 | 1 | 0 | 1 | 0 |
| 50 | 0 | 0 | 1 | 1 | 1 | 1 | 1 | 0 | 1 | 1 | 1 | 0 |
| 51 | 0 | 1 | 1 | 1 | 1 | 1 | 1 | 0 | 1 | 1 | 1 | 0 |
| 52 | 0 | 0 | 1 | 1 | 1 | 1 | 1 | 1 | 1 | 0 | 1 | 0 |
| 53 | 0 | 1 | 1 | 1 | 1 | 1 | 1 | 1 | 1 | 0 | 1 | 0 |
| 54 | 0 | 0 | 1 | 1 | 1 | 1 | 1 | 1 | 1 | 1 | 1 | 0 |
| 55 | 0 | 1 | 1 | 1 | 1 | 1 | 1 | 1 | 1 | 1 | 1 | 0 |
| 56 | 0 | 1 | 1 | 1 | 1 | 1 | 1 | 1 | 1 | 1 | 1 | 1 |
| 57 | 1 | 1 | 1 | 1 | 0 | 1 | 1 | 1 | 1 | 0 | 1 | 1 |
| 58 | 1 | 1 | 1 | 1 | 0 | 1 | 1 | 1 | 1 | 1 | 1 | 0 |
| 59 | 1 | 1 | 1 | 1 | 1 | 1 | 1 | 0 | 1 | 0 | 1 | 0 |
| 60 | 1 | 1 | 1 | 1 | 1 | 1 | 1 | 0 | 1 | 0 | 1 | 1 |
| 61 | 1 | 1 | 1 | 1 | 1 | 1 | 1 | 0 | 1 | 1 | 1 | 0 |
| 62 | 1 | 1 | 1 | 1 | 1 | 1 | 1 | 0 | 1 | 1 | 1 | 1 |
| 63 | 1 | 1 | 1 | 1 | 1 | 1 | 1 | 1 | 1 | 0 | 1 | 0 |

FIG. 7D

| SIGNAL VOLTAGE\ THIRD SCANNING LINE | $V_H$ (STATE A) | $V_L$ (STATE B) |
|---|---|---|
| $V_{DATA}>V_H$ | OFF | OFF |
| $V_L<V_{DATA}<V_H$ | ON | OFF |
| $V_{DATA}<V_L$ | ON | ON |

FIG. 16

ACTIVE MATRIX-TYPE DISPLAY DEVICE

FIELD OF THE INVENTION

The present invention relates to an active-type display device having a pixel circuit for each of a number of pixels and, more particularly, to such a device in which luminance is controlled by changing a light emitting period of a pixel using a pixel signal voltage.

BACKGROUND OF THE INVENTION

Because organic electroluminescent (EL) display devices using a self light emitting organic EL element do not require a backlight as do liquid crystal display devices, EL display devices are advantageous for reducing the thickness of displays. For that reason, and because the viewing angle of EL display devices is not restricted, it is widely anticipated that development of EL display devices will lead to their becoming the next generation of display devices. The organic EL element used in an organic EL display device also differs from a liquid crystal cell in that, while the display in each liquid crystal cell is controlled by an applied voltage, in an organic EL element, the luminance of each of light emitting element is controlled by the value of the current flowing through the element.

As an active matrix system is, compared to a passive matrix system, advantageous in terms of both extending the life of an organic EL element and enlarging screen size, much research and development has focused on development of active matrix systems. Among the proposals that have resulted are a current value modulation method in which gradation display is performed by maintaining a constant light emission period while fluctuating the magnitude of the luminance during each frame of that period, and a time division method in which the gradation display is performed by maintaining a constant emission luminance during the light emitting period while fluctuating the light emission period of the organic EL element.

FIG. 9 shows a pixel circuit in an organic EL display device of the active matrix system of the time division method of a conventional art, such as that disclosed in Japanese Patent Application No. 2002-149113 (Page 24, FIG. 8; Page 25, FIG. 9). From a scanning line driving circuit 106, two scanning lines consisted of a first scanning line 101 and a second scanning line 102 extend to respective pixels. A source supply circuit 107 supplies a positive voltage $V_{DD}$ and a negative voltage $V_{SS}$ to the respective pixels. A signal line driving circuit 108 supplies signal voltages to the respective pixels through a signal line 103. The first scanning line 101 is connected with the gate of a switching element 109, and the n-channel switching element 109 turns on or off a connection of the signal line 103 with the gate of a p-channel driver element 104. The second scanning line 102 is connected with the gate of a discharge switch element 110, and the discharge switch element 110 turns on or off a connection of the positive source $V_{DD}$ with the gate of the driver element 104. To the discharge switch element 110, a capacitance 111 is connected in parallel. One end of the driver element 104 is connected with the positive source $V_{DD}$ and the other end thereof is connected with the negative source $V_{SS}$ via alight emitting element 105.

Accordingly, when the discharge switch element 110 is turned on, both ends of the capacitance 111 are short-circuited for discharging. When the discharge switch element 110 is turned off and the switching element 109 is turned on, a signal voltage of the signal line 103 is written in the capacitance 111, and, in accordance with the written voltage, the driver element 104 and, therefore, the light emitting element 105 are turned on or off.

According to the conventional art, the light emitting period in one frame is determined by a combination of emission off or on subframes which is assigned a weight of 0 to n bits, thus display gradations in accordance with luminance data obtained therefrom. In the conventional art, a problem of visibility called false contours is reduced for a bit having a comparatively longer light emitting period by arranging the bits by dividing and dispersing the light emitting period on the time axis.

In the method, the driver element 104 has a function as a switch for turning on or off the current flowing to the light emitting element 105. In other words, to a gate voltage of the driver element 104 is applied either an on-voltage sufficiently larger than a threshold voltage of the driver element 104 or an off-voltage sufficiently smaller than the threshold voltage. Because the impedance of the driver element 104 is sufficient smaller than the impedance of the light emitting element 105 when the driver element 104 is turned on, the value of the current flowing to the light emitting element 105 while the light emitting element 105 is emitting light is determined by the impedance of the light emitting element 105. Therefore, the influence of inter-element variations of the threshold voltage, mobility, and the like of the driver element 104 are reduced. Accordingly, if the light emitting element 105 maintains uniformity within the display device, the display device is capable of displaying a high quality image having satisfactory uniformity with reduced false contour.

FIG. 11 shows a pixel circuit in an organic EL display device of the active matrix system of the time division method of another conventional art (See, for example, Kageyama et al, "51.1: A2.5 inch OLED Display with a Three-TFT Pixel Circuit for Clamped Inverter Driving", SID04DIGEST, p 1395, FIGS. 3 and 4.). From a scanning line driving circuit 206, two scanning lines consisted of a first scanning line 201 and a second scanning line 202 are extended to respective pixels. A source supply circuit 207 supplies a positive source $V_{DD}$ (positive source voltage $V_{DD}$) and a negative source $V_{SS}$ (negative source voltage $V_{SS}$) to the respective pixels. A signal line driving circuit 208 supplies signal voltages to the respective pixels via a signal line 203. The signal line 203 is connected with the gate of a driver element 204 via capacitance 211, and the source of the driver element 204 is connected with the positive source $V_{DD}$.

The first scanning line 201 is connected with the gate of an n-channel first switching element 209, and the first switching element 209 turns on or off the connection between the gate and the drain of the p-channel driver element 204. The second scanning line 202 is connected with the gate of an n-channel second switching element 210, and the second switching element 210 is provided between the drain of the driver element 204 and an anode of the light emitting element 205 for turning on or off the connection between the second switching element 210 and the driver element 204. Accordingly, in a state where the second switching element 210 is turned on, the current flowing to the driver element 204 flows to the light emitting element 205.

In such a circuit, as shown in FIG. 12, in a state where a signal voltage is supplied to the signal line 203, the first switching element 209 and the second switching element 210 are turned on and then only the second switching element 210 is turned off. By this operation, current from the positive source $V_{DD}$ flows to a gate electrode of the driver element 204 until the voltage between the source and the gate of the driver element 204 comes up to be the threshold voltage of the driver element 204, in a state where the gate and the drain of the driver element 204 are short-circuited, and the difference at this time between the threshold voltage of the driver element and the signal voltage is set at the gate of capacitance 211. Then, the first scanning line 201 is set at L level for turning off the first switching element 209, thus a charging voltage of the capacitance 211 is determined.

Such writing operation of the signal voltage is performed in parallel for pixels of respective columns within one row, and the operation is sequentially performed for respective rows (n rows in FIG. 12). In one frame period, a writing period of the signal voltage in all pixels is first executed, and after writing is complete all pixels enter into a light emitting period.

During the light emitting period, a triangular wave is applied as a reference voltage to the capacitance 211 through the signal line 203, and, during a period where the voltage of the triangular wave is lower than the signal voltage written in the pixels during the data writing period, the driver element 204 is turned on to cause the light emitting element 205 to emit light. According to this method, because the threshold voltage of the driver element 204 can be compensated for, influence of variations of the threshold voltage of the driver element 204 can be further reduced than by the method shown in FIG. 9.

According to this method, decentralized processing for a bit having long light emitting period is not required, as shown in Patent Document 1, and the light emitting element always emit light with an apex of the triangular wave as the center of gravity, thus not causing to generate a visionary problem of principally false contour, and therefore a high quality image with satisfactory uniformity can be displayed.

SUMMARY OF THE INVENTION

However, with the method shown in FIG. 9, because decentralized processing is performed for a bit having a long light emitting period in order to reduce false contour, the number of writings in one frame is increased in an n-bit gradation display, as n +m pieces of subframes exist therein, and, with the increase of the number of writings, a problem results in that power consumption is greatly increased. In addition, particularly with multi-gradation display, writing of 1 bit level is performed at high speed in order to maximize the light emitting period during one frame. However when high speed operation cannot be performed, such as in a case wherein panel size is enlarged and parasitic capacity existing in wiring is increased or the like, multi-gradation fails.

On the other hand, in a method shown in FIG. 11, a problem exists that sufficiently large reservation of a ratio of the light emitting period in one frame (hereinafter referred to as duty ratio) is difficult unless high speed data writing is enabled since transfer to the light emitting period cannot be performed until termination of data writing of all lines.

The present invention provides an active matrix-type display device having a pixel circuit in each of a number of pixels arranged in matrix, in which each pixel circuit includes a light emitting element which emits light using a driving current, a driver element for controlling supply of the driving current to the light emitting element, a capacitance in which a signal voltage is written from a signal line for applying a voltage corresponding to the written signal voltage to the gate of the driver element and a gate potential control line for shifting potential of the capacitance to control gate potential of the driver element, wherein one frame is divided into a plurality of subframes, and in each of the subframes, at least three stages of signal voltage are written in the capacitance from the signal line, and in one of the subframes, after the signal voltage is written in, sub-subframes are formed by further dividing the subframe by changing the gate potential of the driver element by the gate potential control line, and the gate electrode voltage of the driver element in the sub-subframe is controlled by combining the signal voltage and the voltage of the gate potential control line for controlling the light emitting period of the light emitting element.

In addition, a connection of the signal line with the capacitance is preferably controlled by a switching element.

In addition, in each of the subframes, the sum of lengths of all subframe periods is preferably equal to the length of one frame period.

In addition, it is preferable that the sub-subframes, in one frame, have a priority light emitting period for a second half sub-subframe in a first half subframe, and a priority light emitting period for the first half sub-subframe in the second half subframe.

In addition, the lengths of the subframes are preferably equal.

In addition, the driver element is preferably a field effect transistor.

In addition, the field effect transistor is preferably a thin film transistor.

In addition, the light emitting element is preferably an organic EL element.

In the present invention, a gate potential control line is provided on an electrode on a side not connected with a gate electrode of capacitance connected with a gate electrode of a driver element, and, by controlling the gate potential control line, a subframe is divided into sub-subframes, such that the number of the subframes is thus minimized. Then, still smaller sub-subframes are prepared by controlling relationship between the signal voltage written in one subframe and a control line voltage in a predetermined way, whereby the number of writings is reduced and reduction of speed and power consumption of a driving circuit is made possible. In addition, by sequentially performing data writing and gate electrode control processing of the driver element by means of capacitance by scanning processing, it is possible to ensure a duty ratio greater than 90%.

BRIEF DESCRIPTION OF THE DRAWINGS

FIG. 5 is a table showing states of input signals and second scanning lines of the embodiment shown in FIG. 4A;

FIG. 7C is a table showing an example of application of the present invention to a 6 bit gradation display device;

FIG. 7D is a table showing another example of application of the present invention to a 6 bit gradation display device;

FIG. 16 is a table explaining operations of the pixel circuit shown in FIG. 14.

DESCRIPTION OF THE PREFERRED EMBODIMENTS

Exemplary embodiments of the present invention will be explained in detail with reference to the accompanying drawings. It should, however, be noted that the invention is not limited to the example embodiments.

Figure 1:
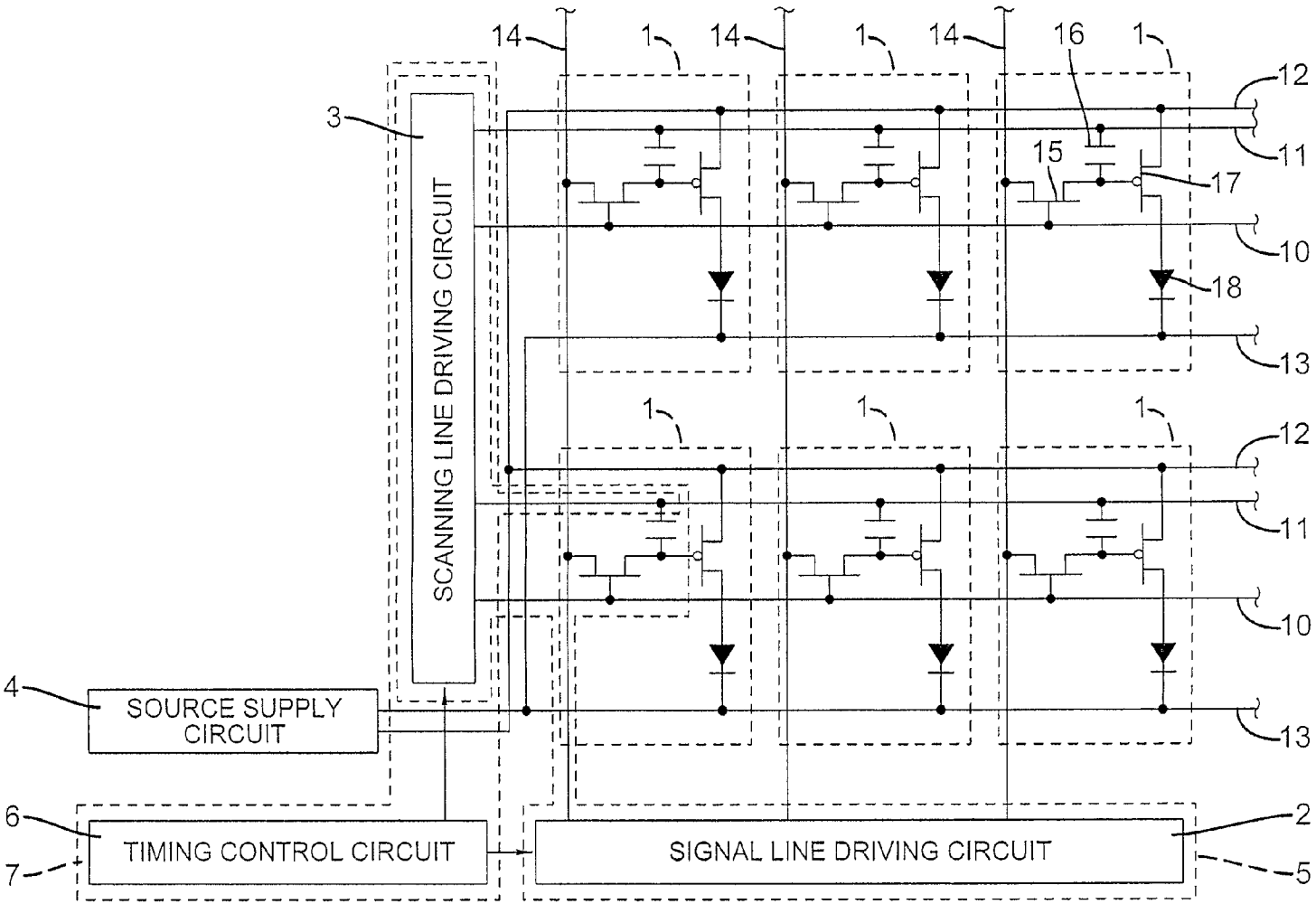
FIG. 1 is a block diagram showing the configuration of one embodiment of the present invention.
Figure 2A:
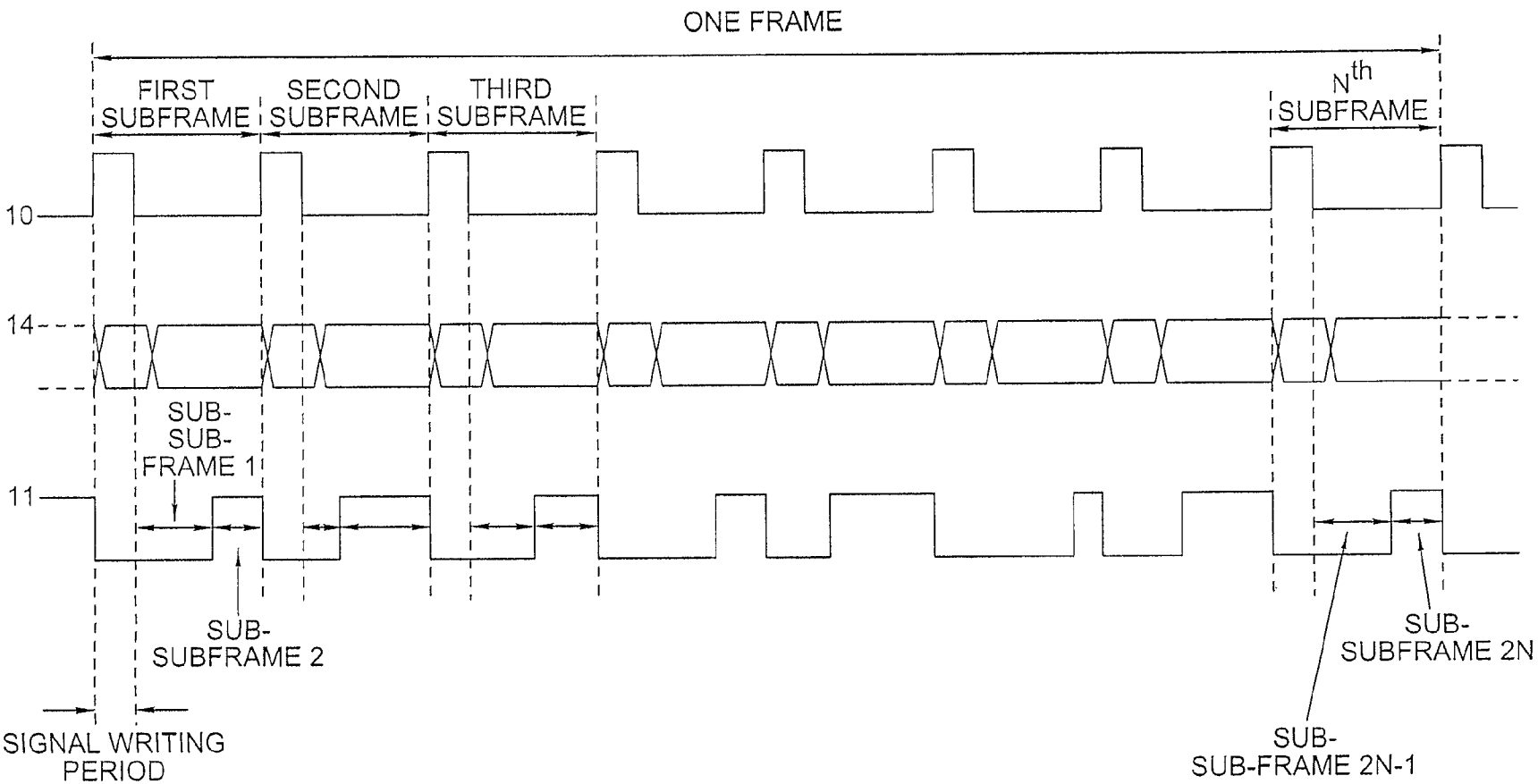
FIG. 2A is a timing chart of the embodiment shown in FIG. 1.

FIG. 1 shows a display device in which the present invention is applied, and FIG. 2A shows a timing chart for explaining an operation thereof.

A source supply circuit 4 is connected with a positive source line 12 maintained at a voltage $V_{DD}$ and a negative source line 13 maintained at a voltage $V_{SS}$, which extend to respective pixels. From a signal line driving circuit 2, signal lines 14 for supplying signal voltages corresponding to luminance signals of respective pixels extend along respective columns. Further, from a scanning line driving circuit 3, a first and second scanning lines 10, 11 for controlling seizure of signal voltages at respective pixels extend along respective rows.

Each of the pixels is provided with an n-channel switching element 15, a capacitance 16, a p-channel driver element 17, and a light emitting element 18. The switching element 15 has the drain or the source being connected with the signal line 14, the source or the drain being connected with the gate of the driver element 17, and the gate being connected with the first scanning line 10. It should be noted that a p-channel switching element 15 may be used.

One end of the capacitance 16 is connected with the gate of the driver element 17, and the other end of the capacitance 16 is connected with the second scanning line 11. The source of the driver element 17 is connected with the positive source line 12, and the drain thereof is connected with an anode electrode of the light emitting element 18. A cathode electrode of the light emitting element 18 is connected with the negative source line 13.

Operations of the above-described display device will be described with reference to the timing charts shown in FIGS. 2A and 2B, the operation states shown in FIGS. 3A to 3C, and the state table shown in FIG. 5.

Figure 2B:
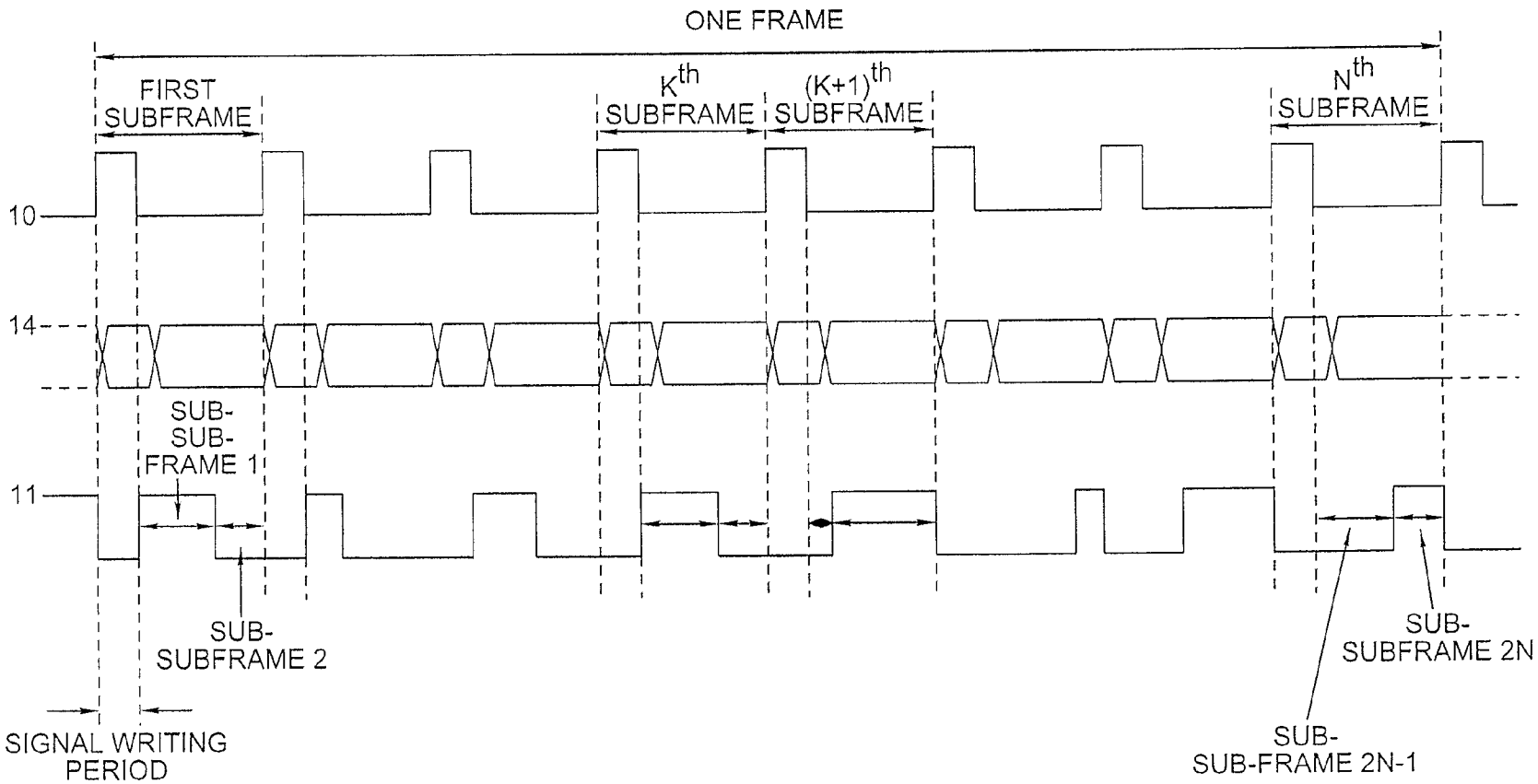
FIG. 2B is another timing chart of the embodiment shown in FIG. 1.

As shown in FIGS. 2A and 2B, one frame is made up of a plurality of subframes, and one subframe thereof is divided into a data writing period and two sub-subframes, the sub-subframes being determined by a level of the second scanning line 11. The subframes correspond to either State A or State B in FIG. 5, depending on the level of the second scanning line 11.

Figure 3A:
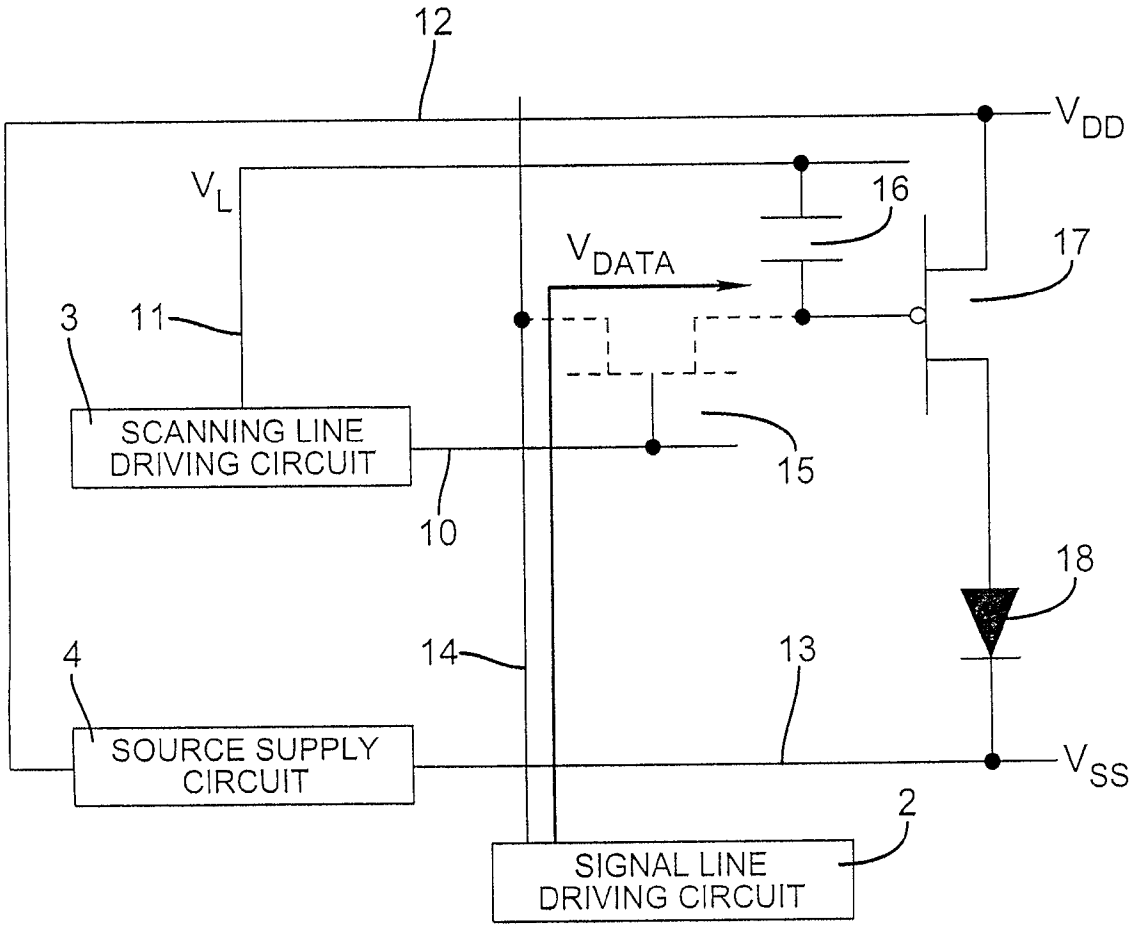
FIG. 3A is a block diagram showing a data writing state of the embodiment shown in FIG. 1.
Figure 3B:
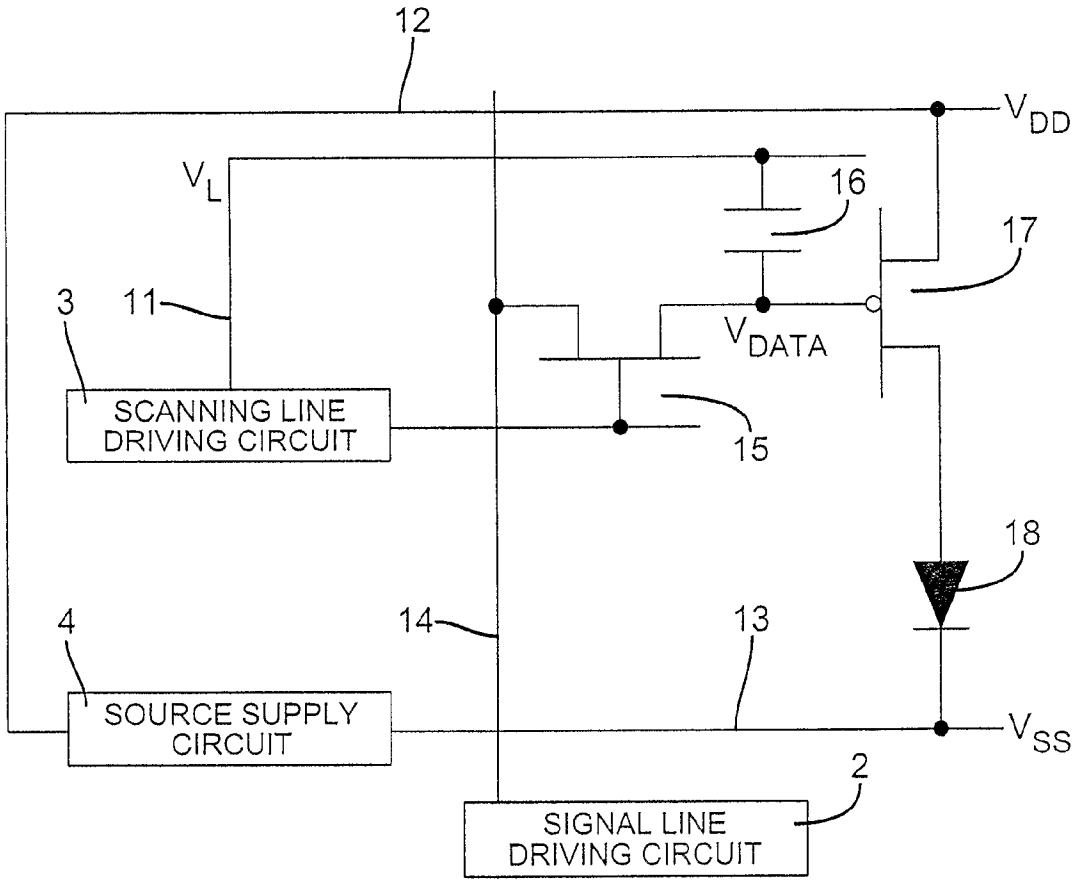
FIG. 3B is a block diagram showing a light emitting state of the embodiment shown in FIG. 1.
Figure 3C:
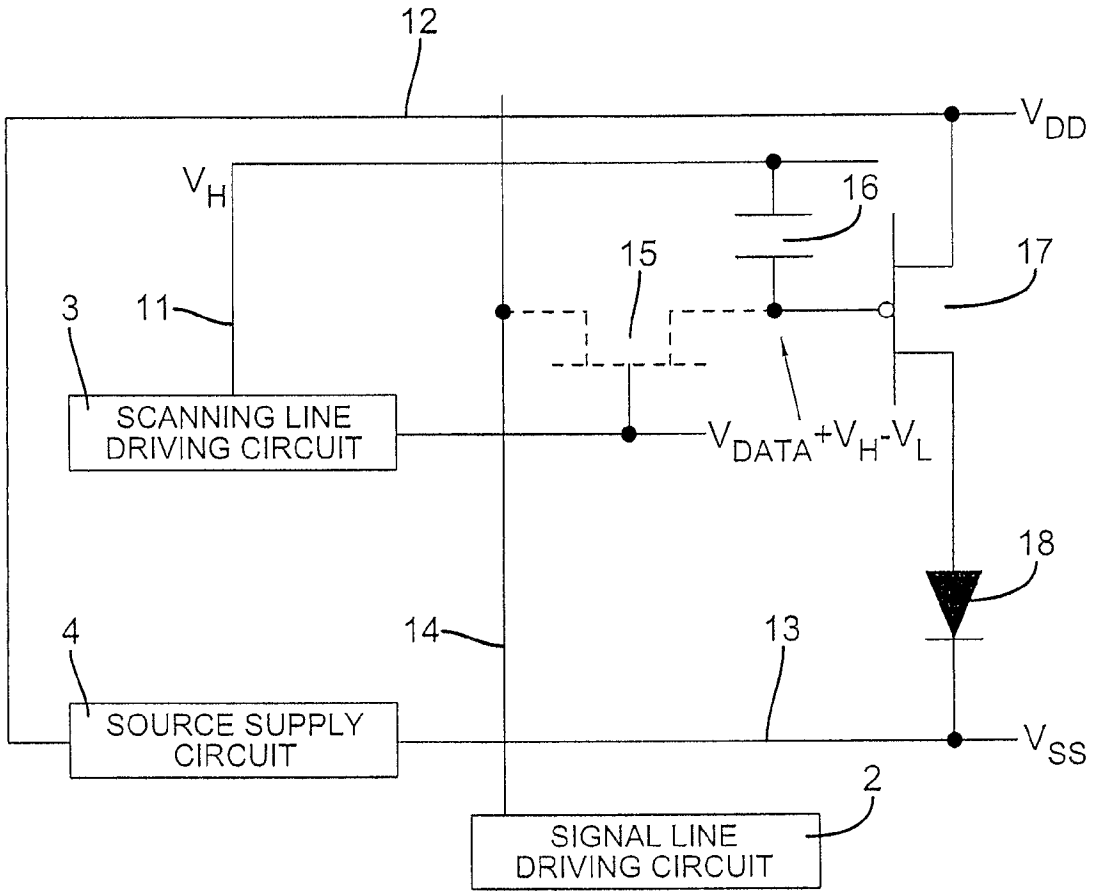
FIG. 3C is block diagram showing another light emitting state of the embodiment shown in FIG. 1.

At the beginning of the process, the signal voltage of the signal line 14 is set at any one of $V_0$, $V_0-V_{D1}$, or $V_0-V_{D1}-V_{D2}$ by the signal line driving circuit 2 and, after the second scanning line 11 is set to a low voltage $V_L$ by a scanning line driving circuit 3, the first scanning line 10 is controlled by the scanning line driving circuit 3 such that the switching element 15 is in conductive state (FIG. 3A). Thereafter, a pixel enters into a sub-subframe which is either in the State A or State B depending on the state of the second scanning line 11. In other words, when the second scanning line 11 is set at $V_L$, the sub-subframe is in the State A, and when it is set at $V_H$, the sub-subframe is in the State B (FIG. 5).

At this time, voltages $V_H$, $V_L$, $V_0$, $V_{D1}$, and $V_{D2}$ are set such that the following below-noted relationships are satisfied when a threshold voltage of the driver element 17 is set at $V_t$. However, when a threshold voltage compensation circuit is introduced into the pixel, $V_t$ is set equal to 0.

$$V_{DD}-V_0<-V_t$$

$$V_{DD}-(V_0-V_{D1})>-V_t$$

$$V_{DD}-(V_0-V_{D1})-(V_H-V_L)<-V_t$$

$$V_{DD}-(V_0-V_{D1}-V_{D2})-(V_H-V_L)>-V_t \qquad \text{Formula 1}$$

In other words, when the signal voltage is $V_0$, even if the voltage of the second scanning line 11 is $V_L$, the relationship $V_{sg}+V_t>0$ for the light emitting condition is not satisfied, regardless as to whether the sub-subframe is in State A or State B, and the subframe therefore does not emit any light at all.

When the signal voltage is expressed by $V_0-V_{D1}$, the relationship $V_{sg}+V_t>0$ is satisfied for the gate voltage of the driver element 17 if the voltage of the second scanning line 11 is $V_L$ (State A: priority sub-subframe which is turned on with priority), and the driver element 17 is turned onto cause the light emitting element 18 to emit light. On the other hand, when the voltage of the second scanning line 11 is $V_H$ (State B), the relationship $V_{sg}+V_t<0$ is applied to the driver element 17, the driver element 17 is turned off, and the light emitting element 18 does not emit light Consequently, only one sub-subframe satisfies the light emitting condition, and the light is emitted only during the sub-subframe period being in the State A.

When the signal voltage is expressed by a mathematical formula $V_0-V_{D1}-V_{D2}$, even if the voltage of the second scanning line is $V_H$, the light emitting relationship $V_{sg}+V_t<0$ is satisfied, irrespective of the sub-subframe being either in State A or State B, and the driver element 17 emits light throughout all subframe periods.

Here, the time ratio between the sub-subframes of the State A and State B in one subframe is controlled by the timing of the second scanning line 11. Accordingly, the time ratio of the sub-subframes can be controlled by controlling the duty ratio of the second scanning line 11. It is also possible that the sequence of the State A and State B can be altered in an arbitrary subframe as shown in FIG. 2B.

In any display device of, for example, 6 bit gradation (luminance level being 0 to 63), configured according to the method described in the related art described above, when the frame frequency of an image is 60 Hz in one frame, a duty ratio of 87.5% can be realized with a subframe rate of 60×9=540 Hz. On the other hand, according to the method illustrated in FIG. 7D of the present embodiment, a duty ratio of 95.5% can be ensured with a subframe rate of 60×6=360 Hz.

Figure 13:
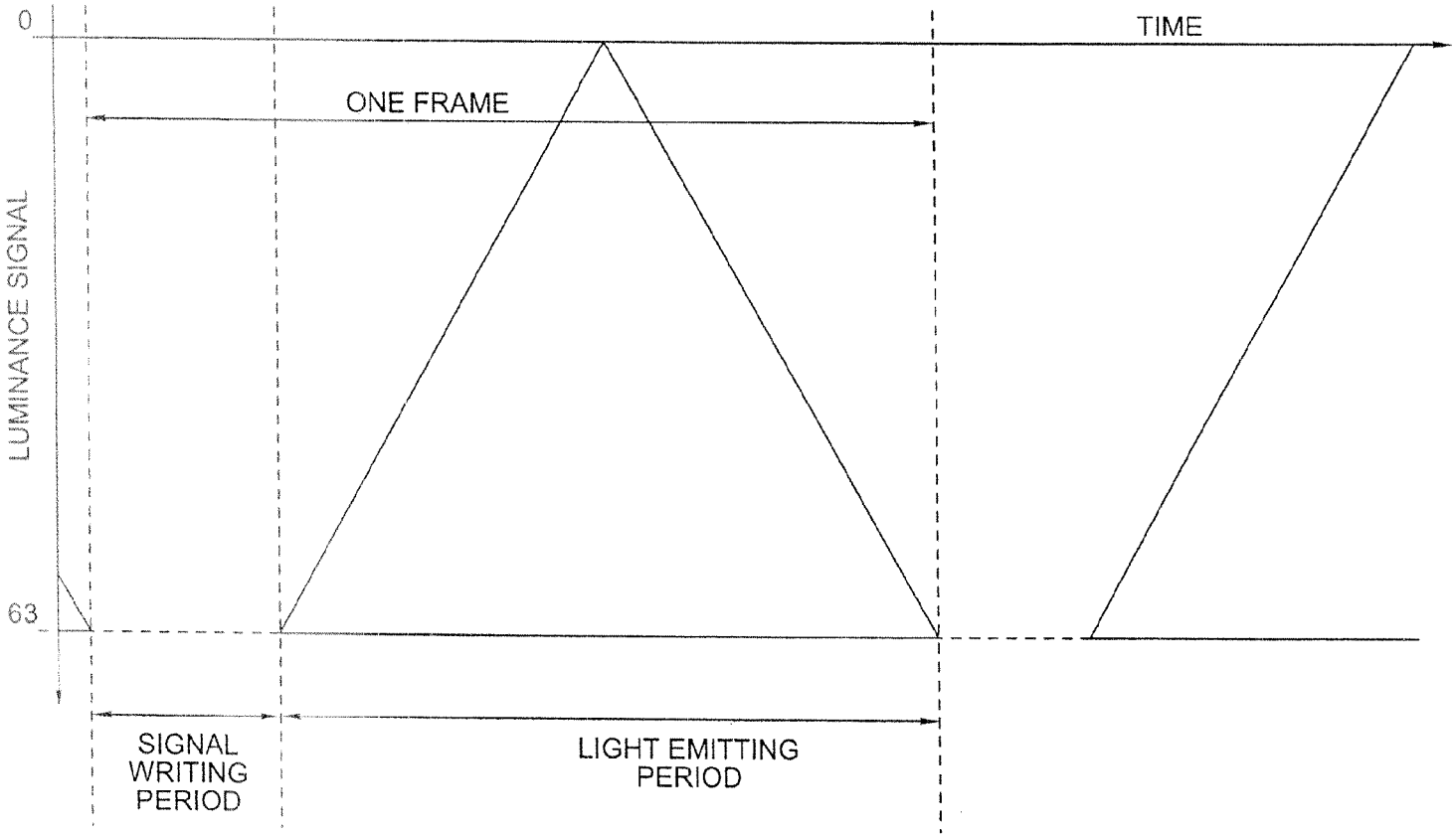
RELATED ART FIG. 13
FIG. 13 is a timing chart showing a state of light emitting in 6 bit gradations of the another conventional pixel circuit 2.

Because the period ratio and sequence of the State A and the State B in a sub-subframe can be arbitrarily altered, the false contour can be reduced by approximation to the light emitting characteristic shown in FIG. 13 as described in the non-patent art discussed above, without increasing the refreshing number as n+m times as described in the cited patent application. Furthermore, because a duty ratio of almost 100% can be secured by the method according to the present embodiment in conjunction with the related art method described above, which does not generate false contours, the current density of the light emitting element at the time of light emitting can be reduced enabling elongation of lifetime and reduction of power consumption of the light emitting element; both are clearly advantages.

Figure 4A:
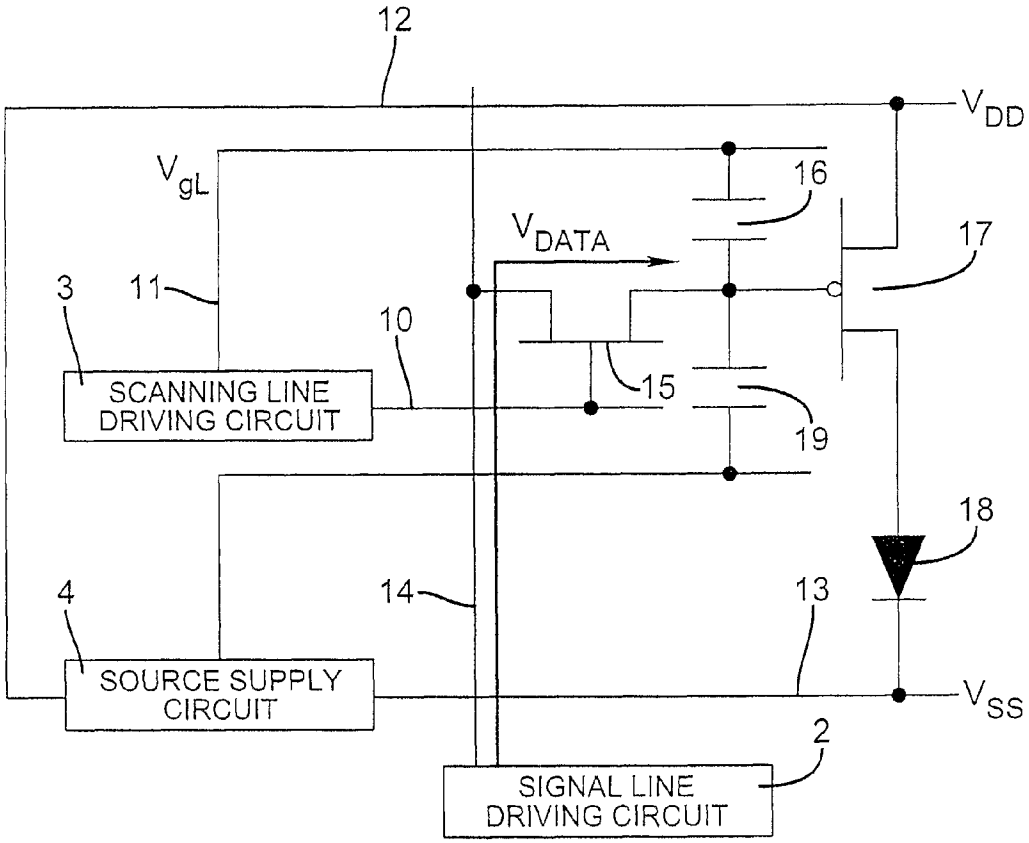
FIG. 4A is a block diagram showing a data writing state according to another embodiment of the present invention.
Figure 4B:
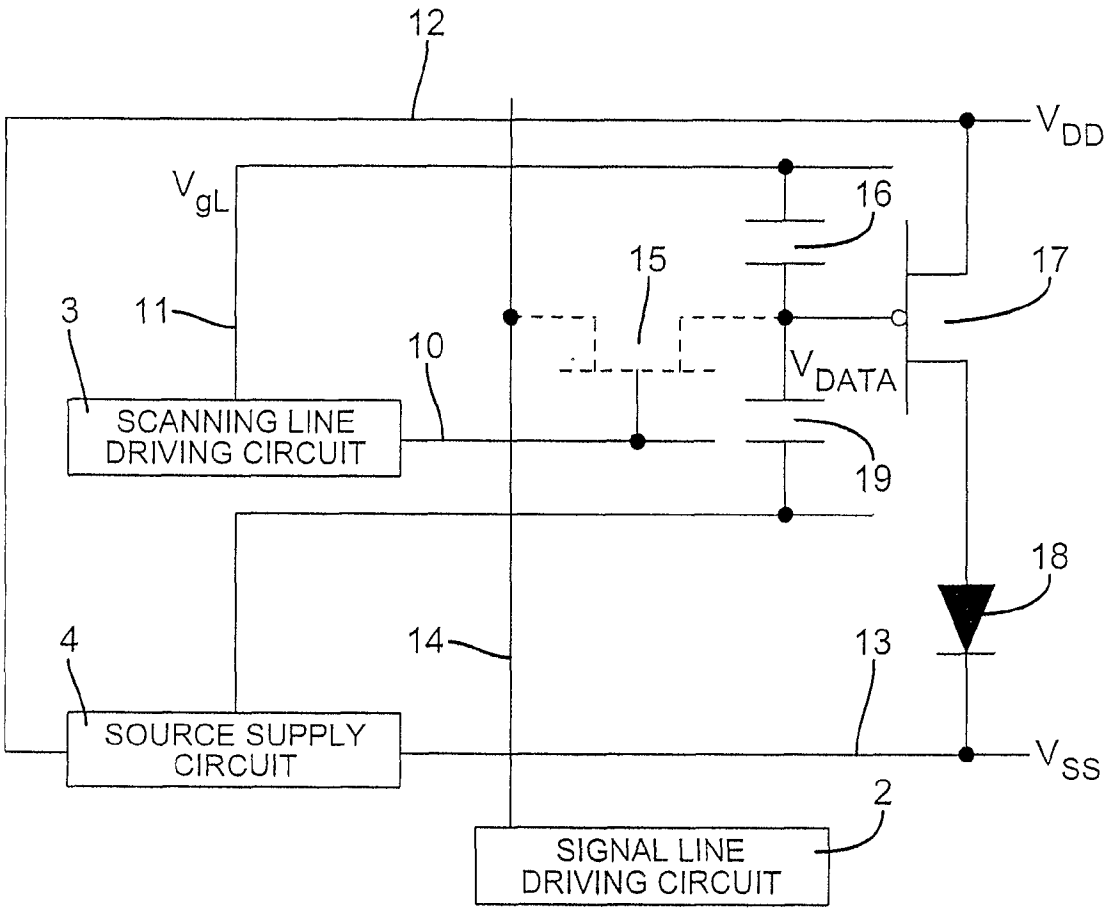
FIG. 4B is a block diagram showing a light emitting state of the embodiment shown in FIG. 4A.
Figure 4C:
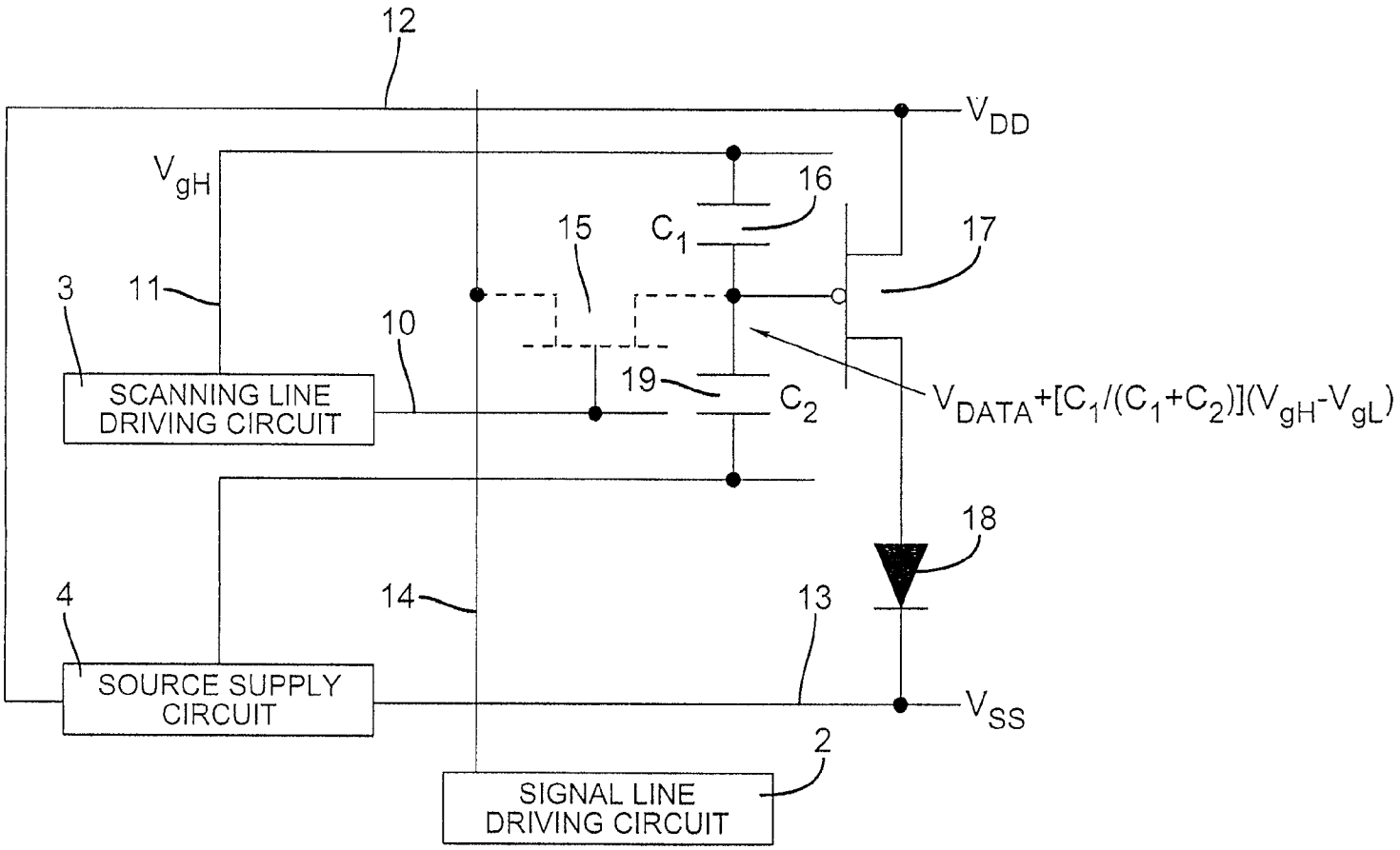
FIG. 4C is a block diagram showing another light emitting state of the embodiment shown in FIG. 4A.
Figure 6A:
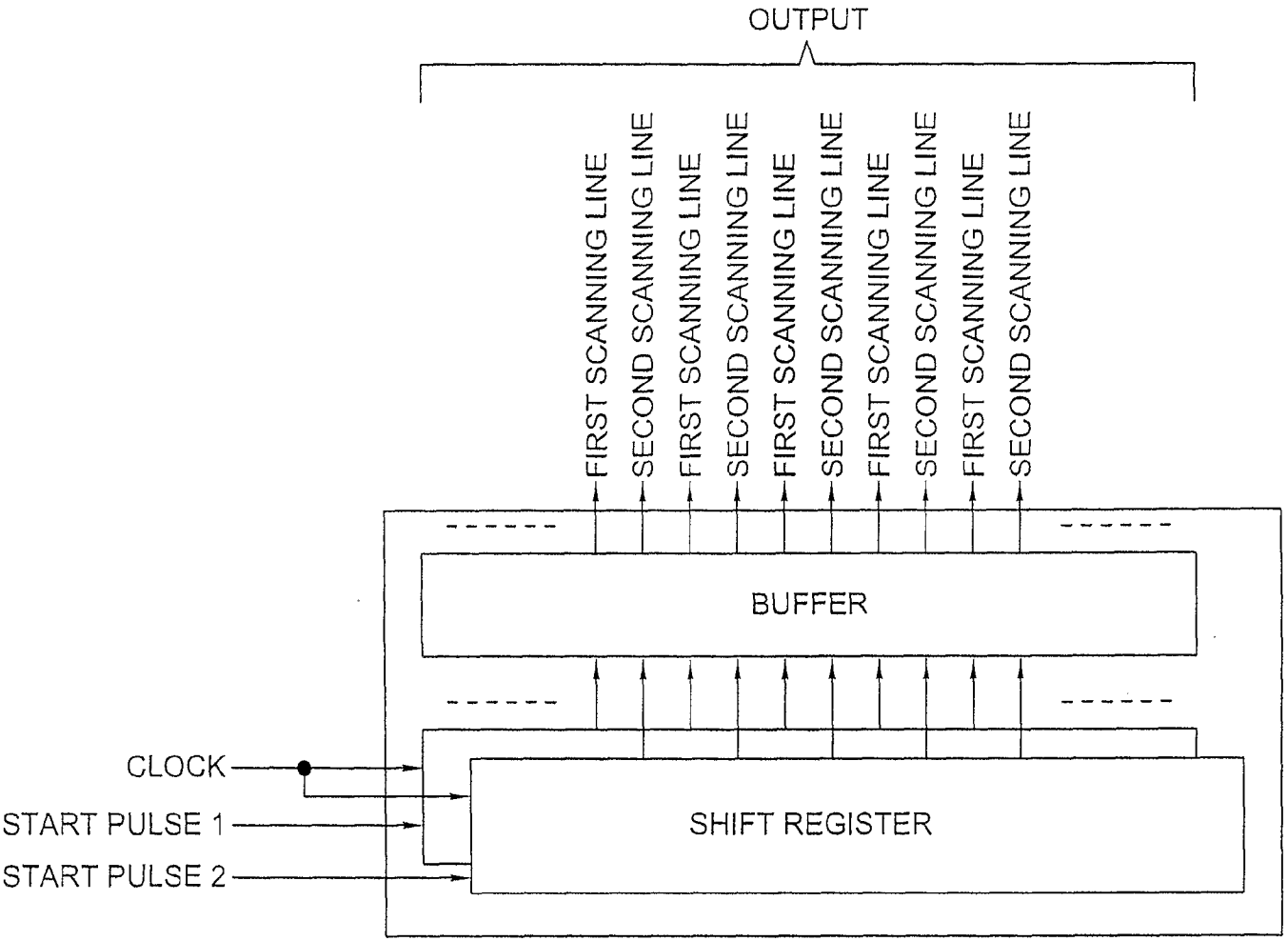
FIG. 6A is a block diagram showing example 1 of scanning line driving circuit utilized in the embodiment shown in FIG. 4A.
Figure 6B:
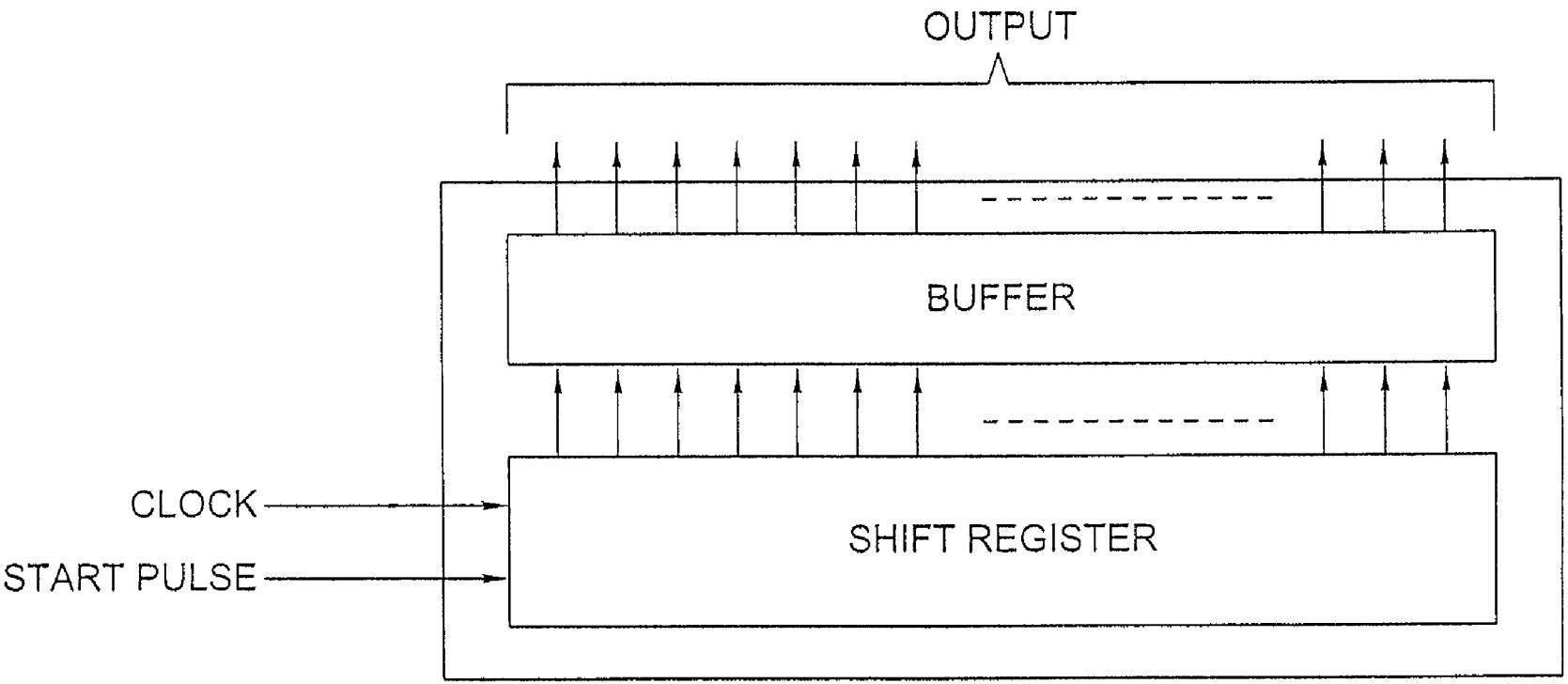
FIG. 6B is a block diagram showing example 2 of scanning line driving circuit utilized in the embodiment shown in FIG. 4A.

FIGS. 4A to 4C show the configuration and operation of another embodiment of the present invention. In this example, the gate of the driver element 17 is connected with one end of capacitance 19, other end thereof being maintained at a constant voltage supplied from a source supply circuit 4. Accordingly, as shown in FIG. 4A, when a voltage $V_{data}$ is supplied from the signal line 14 to the gate of the driver element 17, the capacitance 19 is also charged. Then, as shown in FIG. 4B, even when the switching element 15 is turned off, the gate voltage of the driver element 17 is maintained at $V_{data}$. However, when the voltage of the second scanning line 11 is changed from $V_{gL}$ to $V_{gH}$ by the scanning line driving circuit 3, the gate voltage of the driver element 17 is changed to the one expressed by a mathematical formula $V_{data}+[C_1/(C_2+C_2)](V_{gH}-V_{gL})$. Here, $C_1$ is a capacity value of the capacitance 16, and $C_2$ is the capacity value of the capacitance 19. It should be noted that, although the source voltage to which the other end of the capacitance 19 is connected may be any voltage as long as it is constant, a preferable voltage is that held by the source supply circuit 4, namely, $V_{SS}$ or the like.

With such a configuration, similar operation to that described above can be obtained.

Figure 7A:
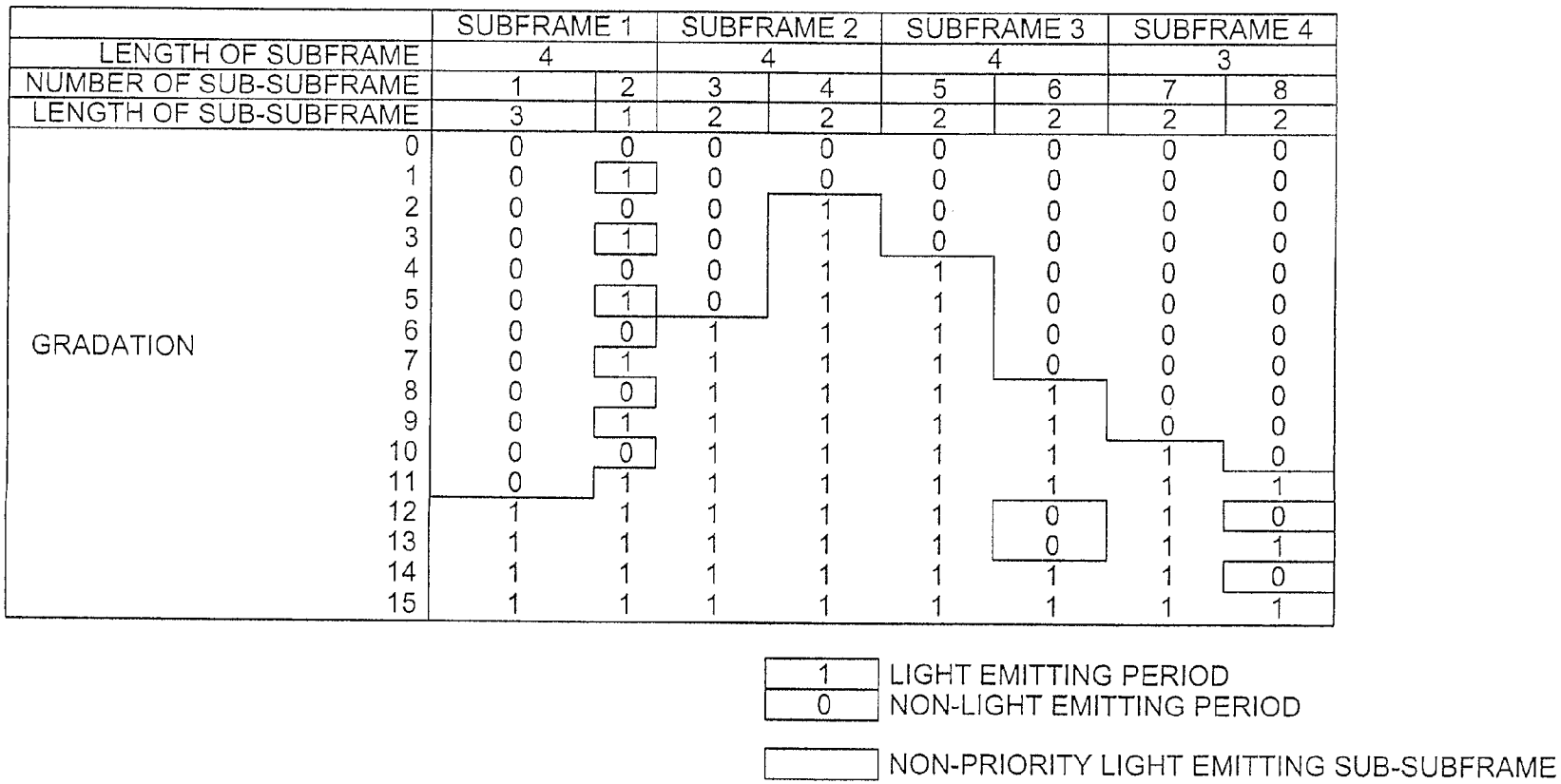
FIG. 7A is a table showing an example of application of the present invention to a 4 bit gradation display device.
Figure 7B:
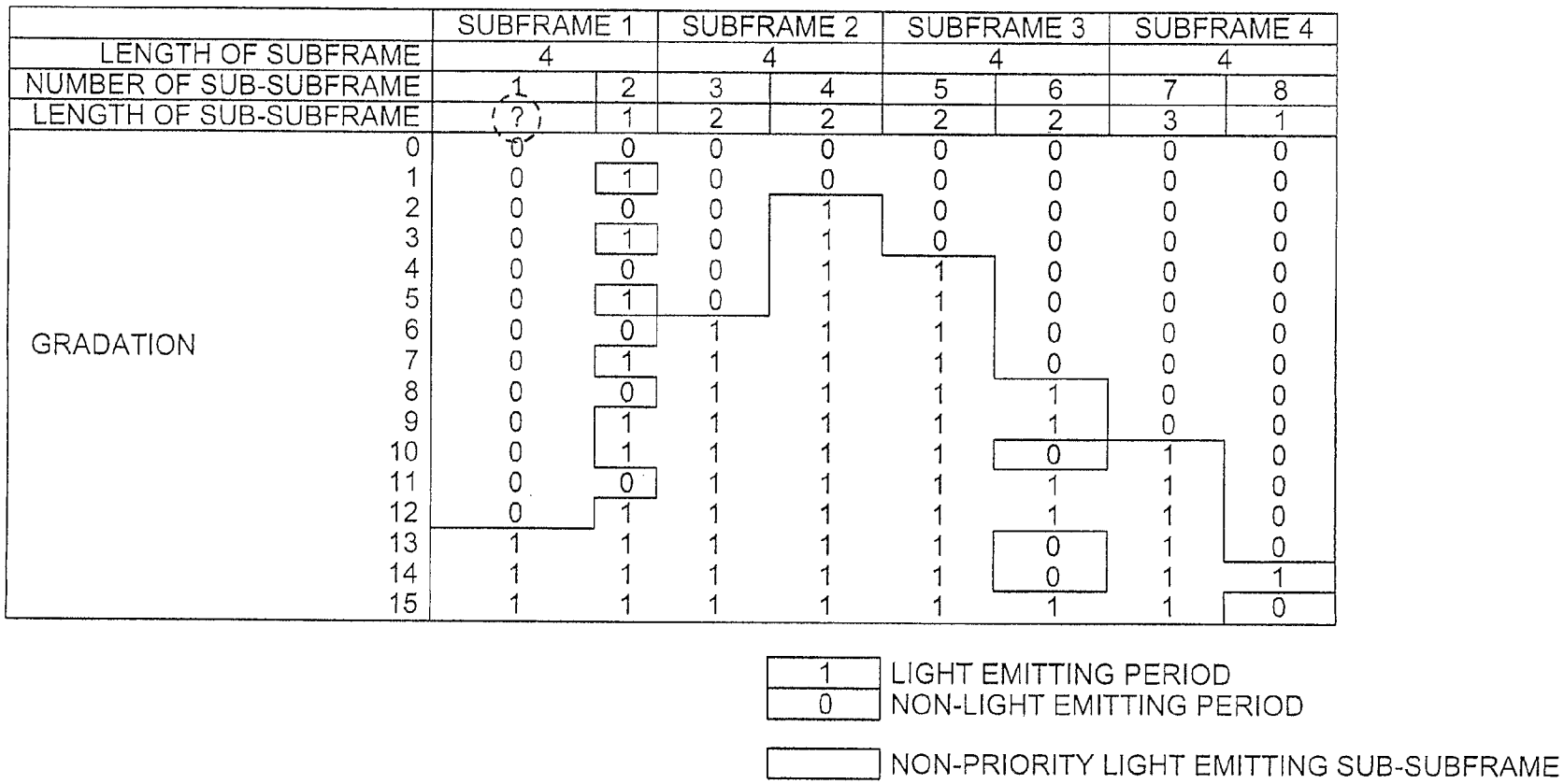
FIG. 7B is a table showing another example of application of the present invention to a 4 bit gradation display device.

FIG. 7A shows an example of control in case of 4 bits (16 gradations). In this case, four subframes 1 to 4 are prepared. Then, the subframe 1 having a total length of 4 units is divided into two sub-subframes, the first half thereof having a length of 3 units and the second half having a length of 1 unit (3:1), with the second half being the priority light emitting period; the subframe 2 having a total length of 4 units is divided into two sub-subframes, each of the first half and the second half thereof having a length of 2 units, respectively (2:2), with the second half being the priority light emitting period; the subframe 3 having a total length of 4 units is divided into two sub-subframes, each of the first half and the second half thereof having a length of 2 units, respectively (2:2), with the first half being the priority light emitting period; and the subframe 4 having a total length of 3 units is divided into two sub-subframes, the first half thereof having a length of 2 units and the second half having a length of 1 unit (2:1), with the first half being the priority light emitting period. With this arrangement, when respective sub-subframes are turned on or off, all duty ratios corresponding to the gradations 0 to 15 can be realized. These signals for turning on or off need only correspond with rates of the subframes, and the requirement is satisfied with a frequency equivalent to 4 times the frame rate. It should be noted that, in FIG. 7, the sub-subframes marked 1 emits light. It should also be noted that other examples of make-up of sub-subframes which realize 4 bits (16 gradations) with 4 subframes are available otherwise such as the one shown, for example, in FIG. 7B in which lengths of all subframes are made equal.

Similarly, a case employing 5 bits (32 gradations) is possible with 5 subframes, in which the subframe 1 having a total length of 7 units is divided into two sub-subframes, the first half thereof having a length of 6 units and the second half having a length of 1 unit (6:1), with the second half being the priority light emitting period; the subframe 2 having a total length of 6 units is divided into two sub-subframes, the first half thereof having a length of 4 units and the second half having a length of 2 units (4:2), with the second half being the priority light emitting period; the subframe 3 having a total length of 6 units is divided into two sub-subframes, each of the first half and the second half thereof having a length of 3 units, respectively (3:3), with the first half being the priority light emitting period; the subframe 4 having a total length of 6 units is divided into two sub-subframes, the first half thereof having a length of 4 units and the second half having a length of 2 units (4:2), with the first half being the priority light emitting period; and the subframe 5 having a total length of 6 units is divided into two sub-subframes, the first half thereof having a length of 5 units and the second half having a length of 1 unit (5:1), with the first half being the priority light emitting period. With this configuration, all duty ratios corresponding to the gradations 0 to 31 can be realized by turning on or off respective sub-subframes.

Moreover, when further increase in the number of gradations is desired, such can be provided by increasing the number of subframes and the division rate in the sub-subframes. For example, as shown in FIG. 7C, in a case with 6 bits (64 gradations), the duty ratio of 0 to 100% can be realized by preparing 6 subframes and providing sub-subframes of 10:1, 9:2, 7:4, 6:4, 8:2, and 9:1. It should be noted that other examples of make-up of sub-subframes which realize display of 6 bits (64 gradations) with 6 subframes are also available, such as shown in FIG. 7D.

Here, the number of subframes corresponding to the number of gradations necessary for display is determined in the following manner in accordance with the number of gradations of the sub-subframes.

The number of the gradations of a display device is set as n bits, and the number of the subframes is set as m. The gradations expressed by respective subframes are configured as:

$$[2^n/m] \text{ or } [2^n/m]-1 \text{ (here [ ] is gauss notation) and}$$

$$(1(\leqq 2^P) \text{ or } 2^n-1,\ P=0, 1, 2, \ldots, P\leqq m/2).$$

Example 1

Figure 8A:
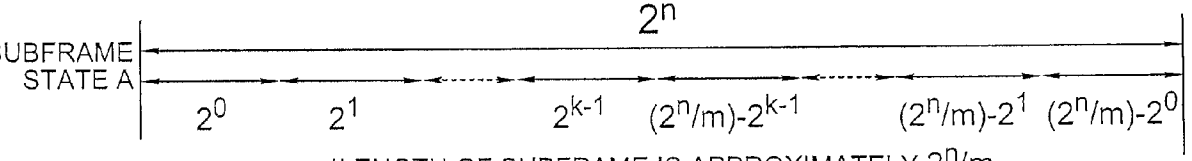
FIGS. 8A, 8B, 8C and 8D are charts illustrating conditions enabling expressions by all gradations.

When the duty ratio is approximately 100[%], determination is made in the following manner:

(A) When m=2k (k=1, 2, 3, . . . ), the number of gradations per one subframe is expressed by $2^n/2k$, and a condition for expressing all gradations from FIG. 8A is expressed by the following formula:

$$1+\sum_{r=0}^{k-1}2^r=2^k\geq 2^n/2k-2^{k-1}\Leftrightarrow 6k\cdot 2^{k-1}\geq 2^n \quad \text{Formula 2}$$

It is preferable that the number of subframes m is the minimum value of k which satisfies the above formula.

Figure 8B:
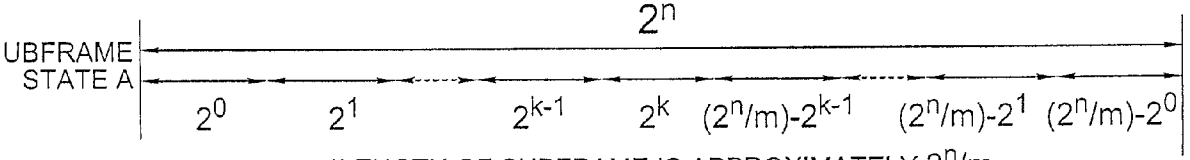

(B) When m=2k+1 (k=0, 1, 2, . . . ), the number of gradations per one subframe is expressed by $2^n/(2k+1)$, and a condition for expressing all gradations from FIG. 8B is expressed by the following formula:

$$2^k\geqq 2^n/(2k+1)-2^k\Leftrightarrow(2k+1)\cdot 2^{k+1}\geqq 2^n \quad \text{Formula 3}$$

Preferably, the number of subframes of m expressed by k is the minimum number for satisfying the above formula.

Example 2

When the duty ratio is approximately 100(m−1)/m[%], determination is made as follows.

Figure 8C:
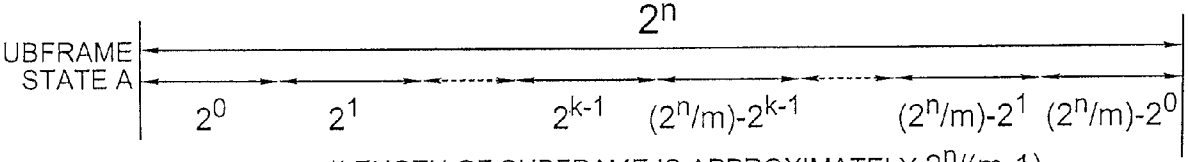

(C) When m=2k (k=1, 2, 3, . . . ), the number of gradations per one subframe is expressed by $2^n/(2k+1)$, and a condition for expressing all gradations from FIG. 8C is expressed by the following formula:

$$1+\sum_{r=0}^{k-1}2^r=2^k\geq 2^n/(2k-1)-2^{k-1}\Leftrightarrow 3(2k-1)\cdot 2^{k-1}\geq 2^n \quad \text{Formula 4}$$

It is preferable that the number of subframes m is the minimum value of k which satisfies the above formula.

Figure 8D:
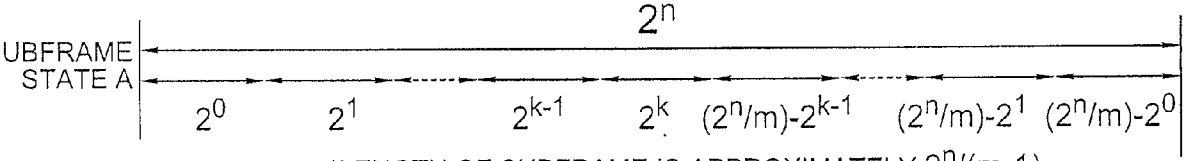
Figure 9:
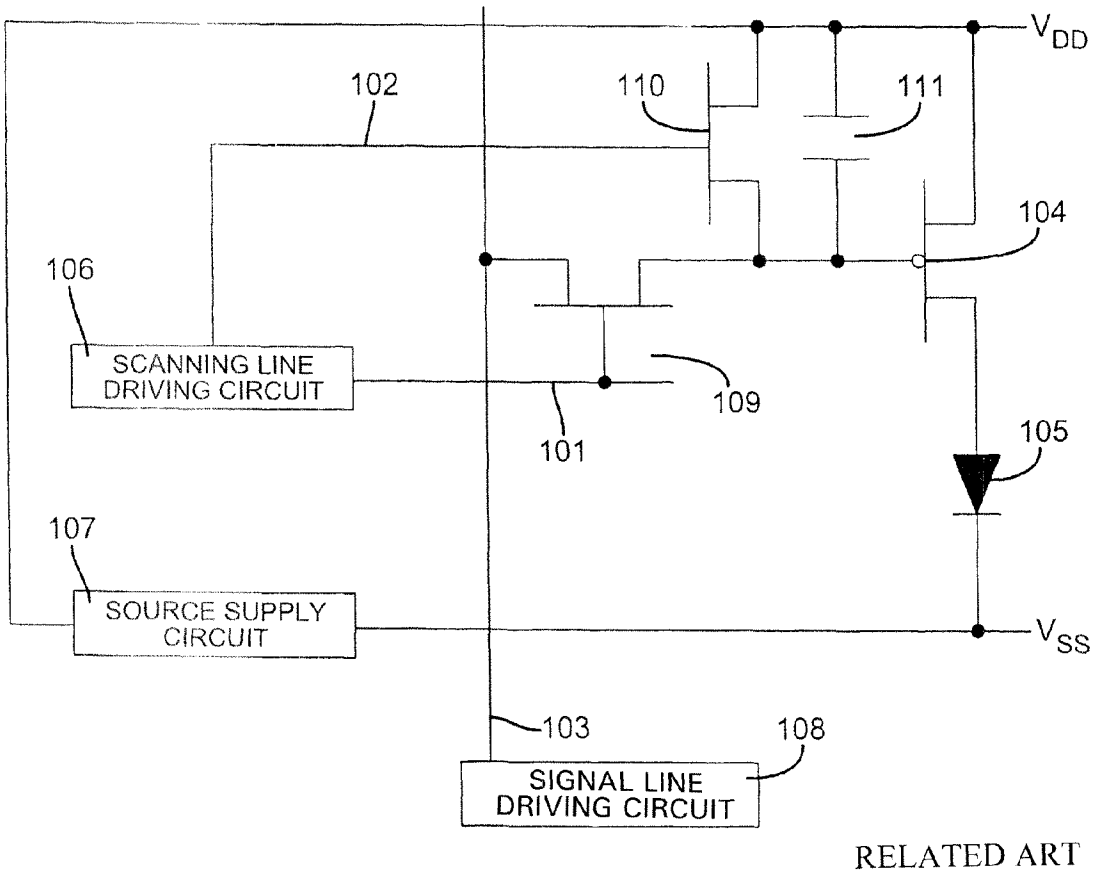
RELATED ART FIG. 9
FIG. 9 is a block diagram showing the configuration of a conventional pixel circuit 1.
Figure 10:
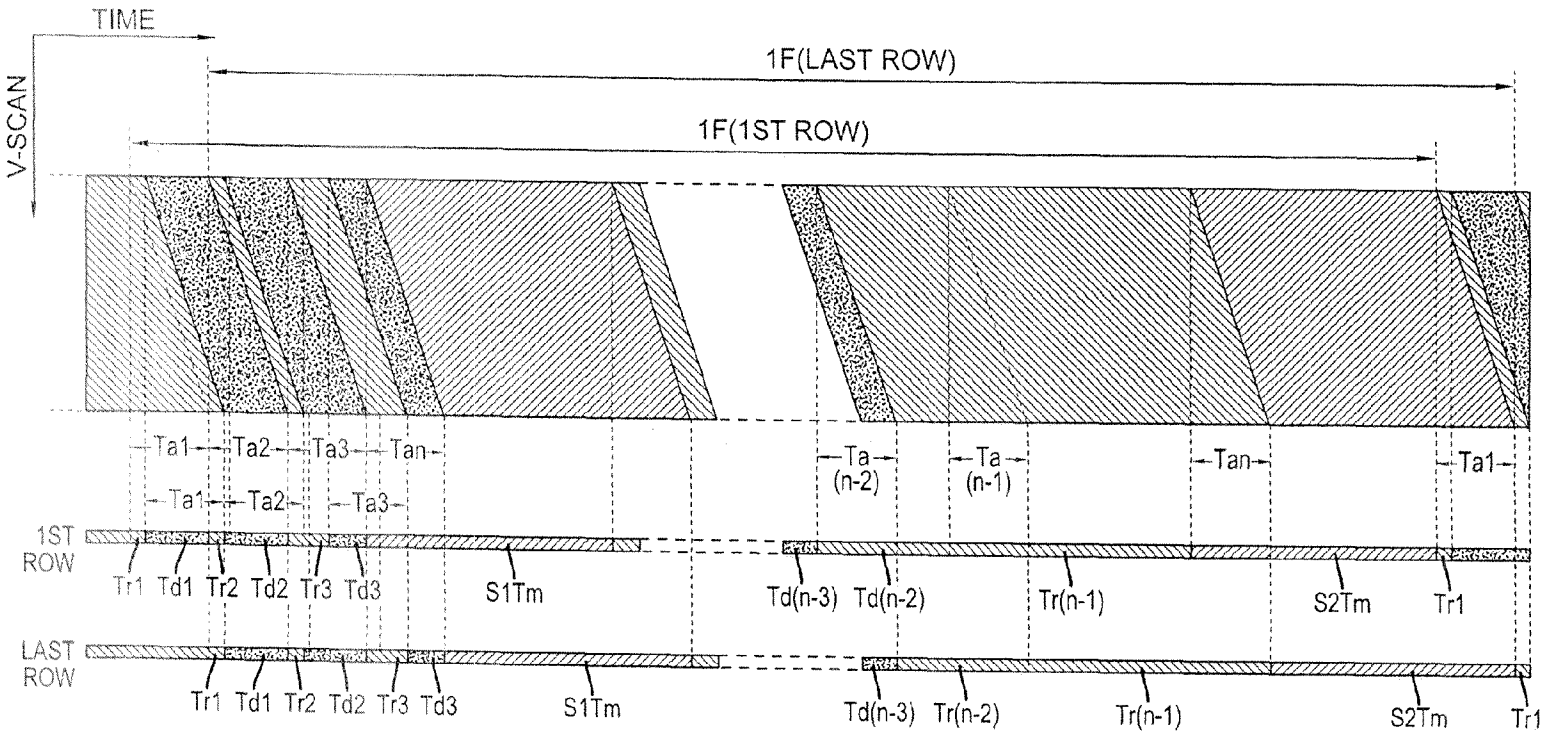
RELATED ART FIG. 10
FIG. 10 is a timing chart of the conventional pixel circuit 1.
Figure 11:
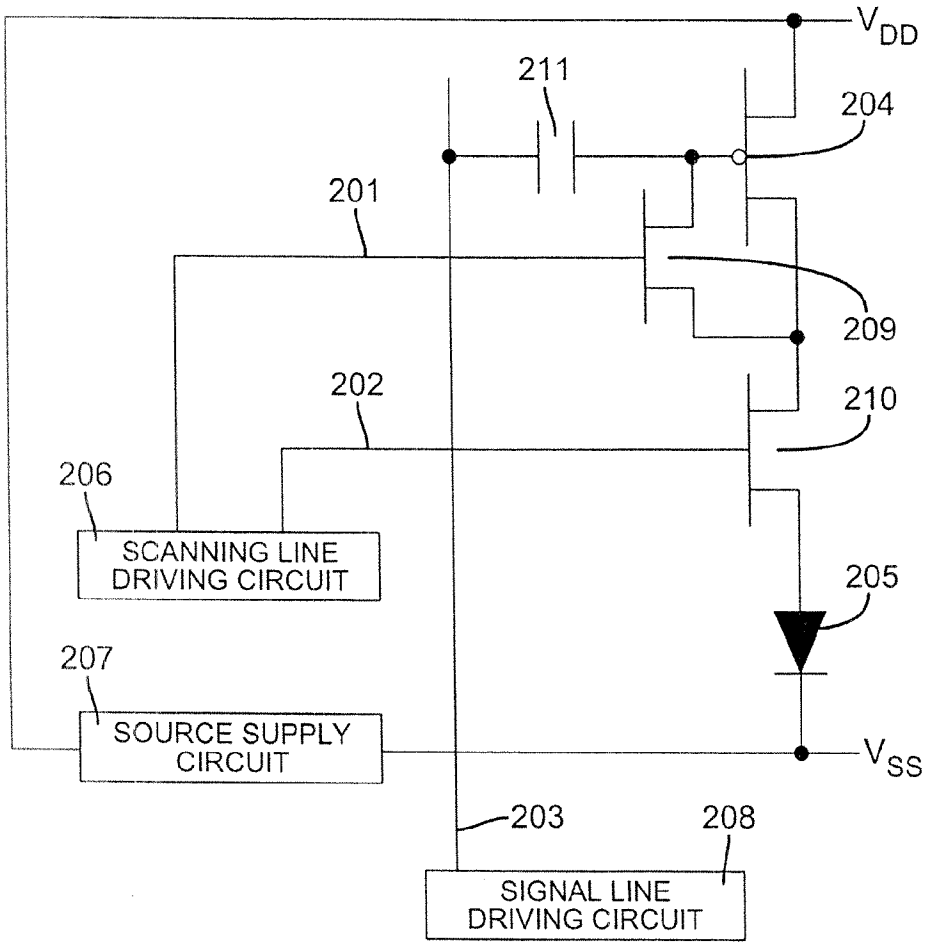
RELATED ART FIG. 11
FIG. 11 is a block diagram showing a make-up of another conventional pixel circuit 1.
Figure 12:
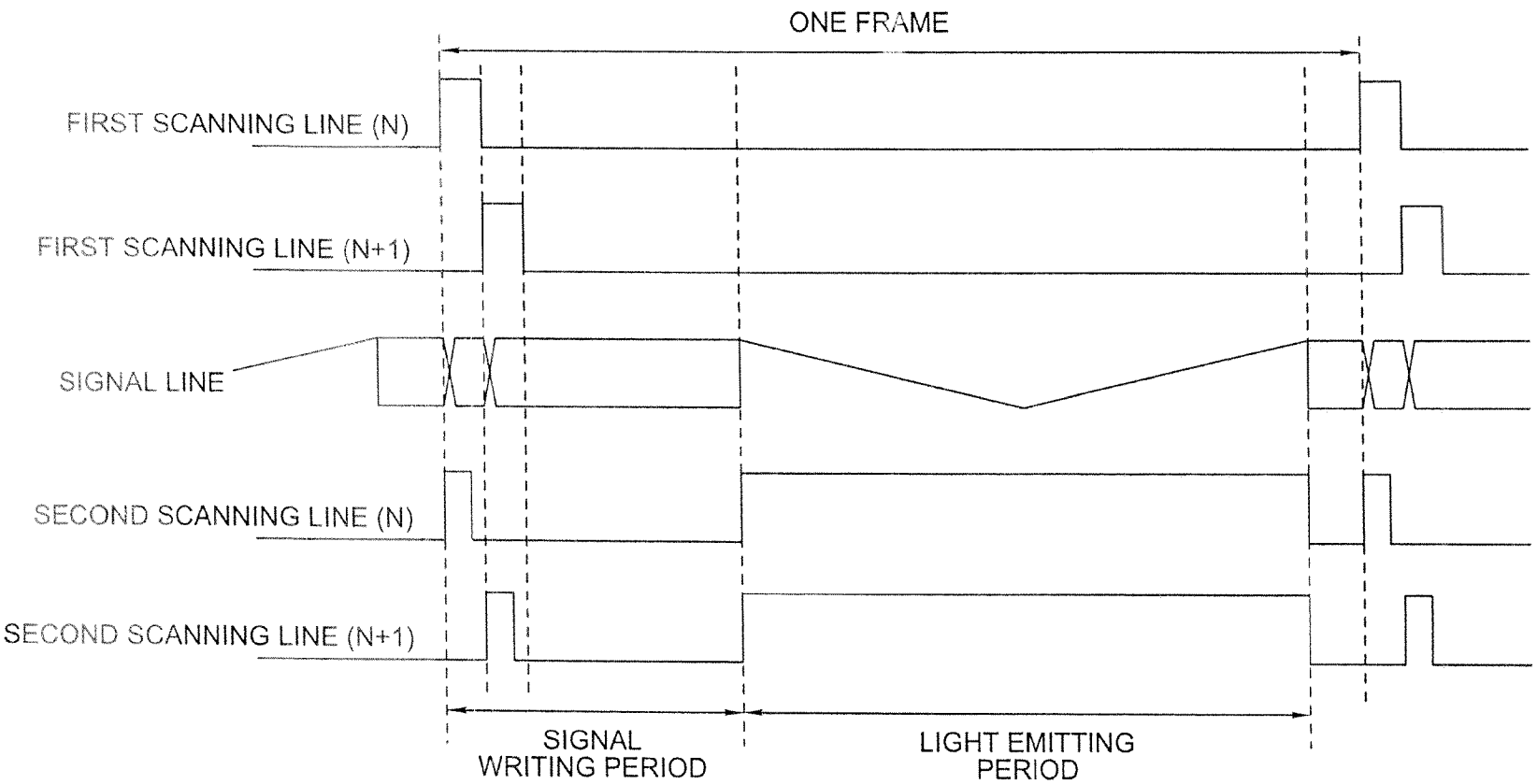
RELATED ART FIG. 12
FIG. 12 is a timing chart of the another conventional pixel circuit 2.

(D) When m=2k+1 (k=0, 1, 2, . . . ), the number of gradations per one subframe is expressed by $2^n/(2k)$, and a condition for expressing all gradations from FIG. 8D is expressed by the following formula:

$$2^k\geqq 2^n/2k-2^k\Leftrightarrow k\cdot 2^{k+2}\geqq 2^n \quad \text{Formula 5}$$

It is preferable that the number of subframes m is the minimum value of k which satisfies the above formula.

According to the present embodiment, the number of gradations desirably expressed is expressed, in this manner, utilizing the sub-subframes. The frequency of the subframe does not change even if the duty ratio between two sub-subframes within one subframe is altered. Accordingly, display of larger gradations can be achieved while maintaining a small subframe display rate.

Figure 14:
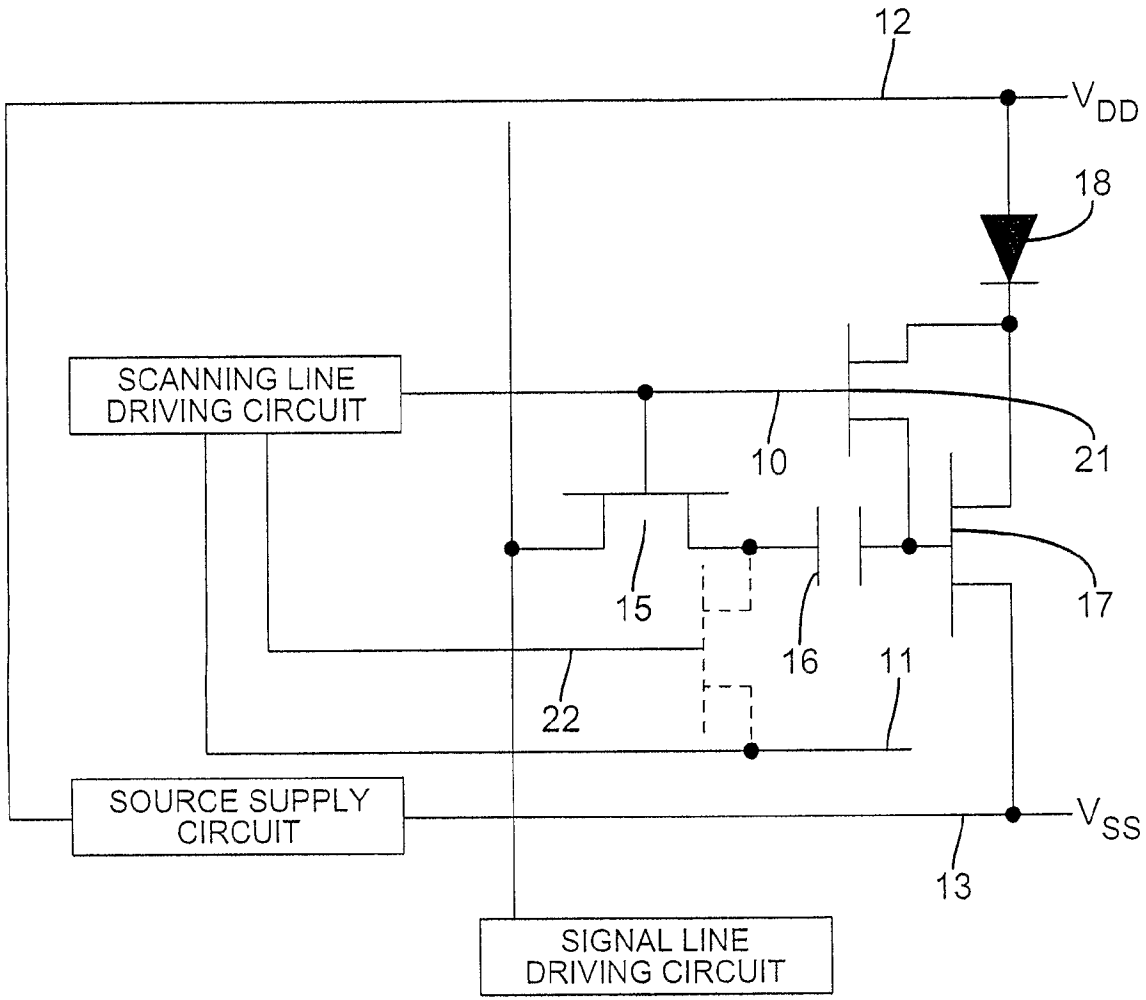
FIG. 14 is a block diagram showing an example configuration of another pixel circuit.

FIG. 14 shows another example of pixel circuit makeup. In this example, an anode of the light emitting element 18 is connected with the positive source line 12, a cathode thereof is connected with the drain of the n-channel driver element 17, and the source of the driver element 17 is connected with the negative source line 13. Further, between the drain and the gate of the driver element 17, a switching element 21 for short-circuiting is provided, and the gate of the switching element 21 for short-circuiting is connected with the first scanning line 10. Furthermore, a capacitance 16 is arranged between the gate of the driver element 17 and the source or drain of the switching element 15 (on a side which is not connected with the signal line 14).

Figure 15A:
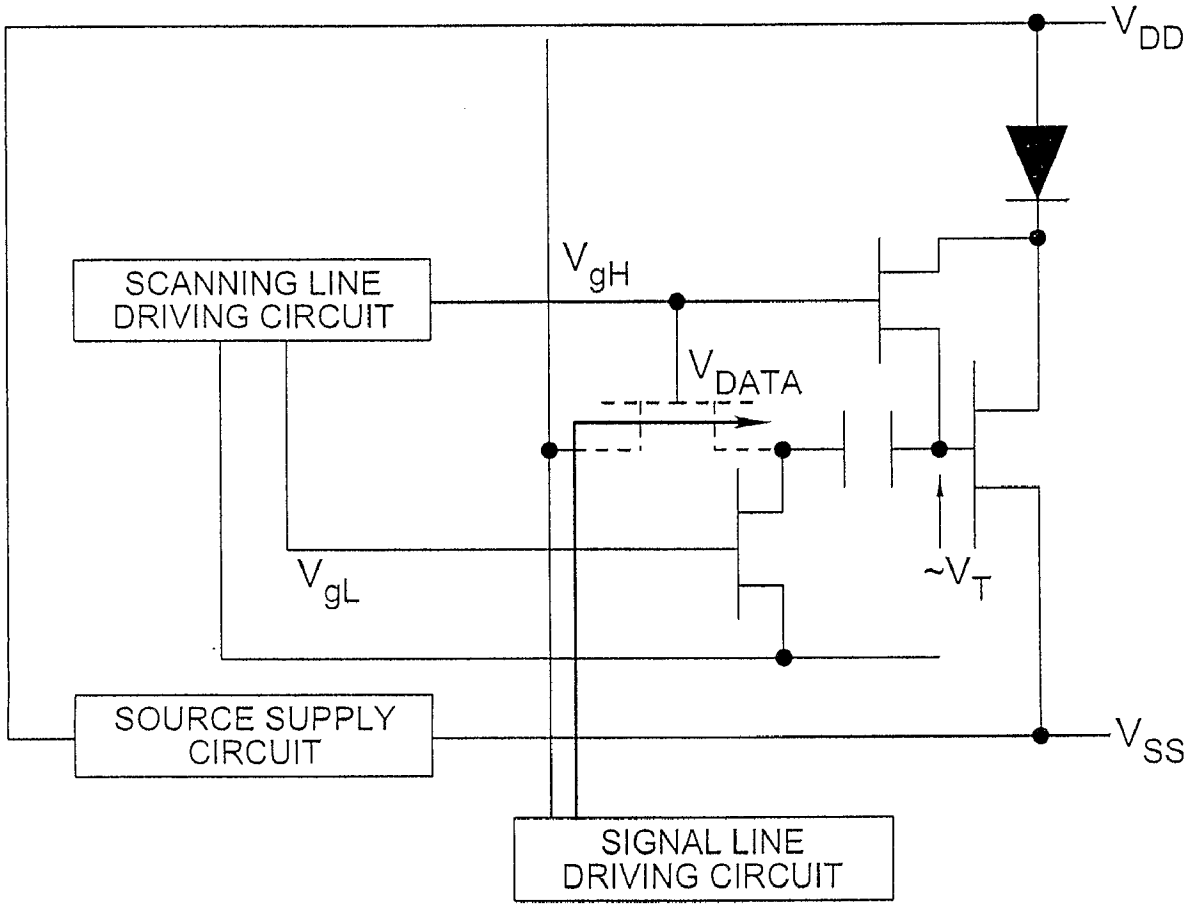
FIG. 15A is a block diagram explaining operations of the pixel circuit shown in FIG. 14.
Figure 15B:
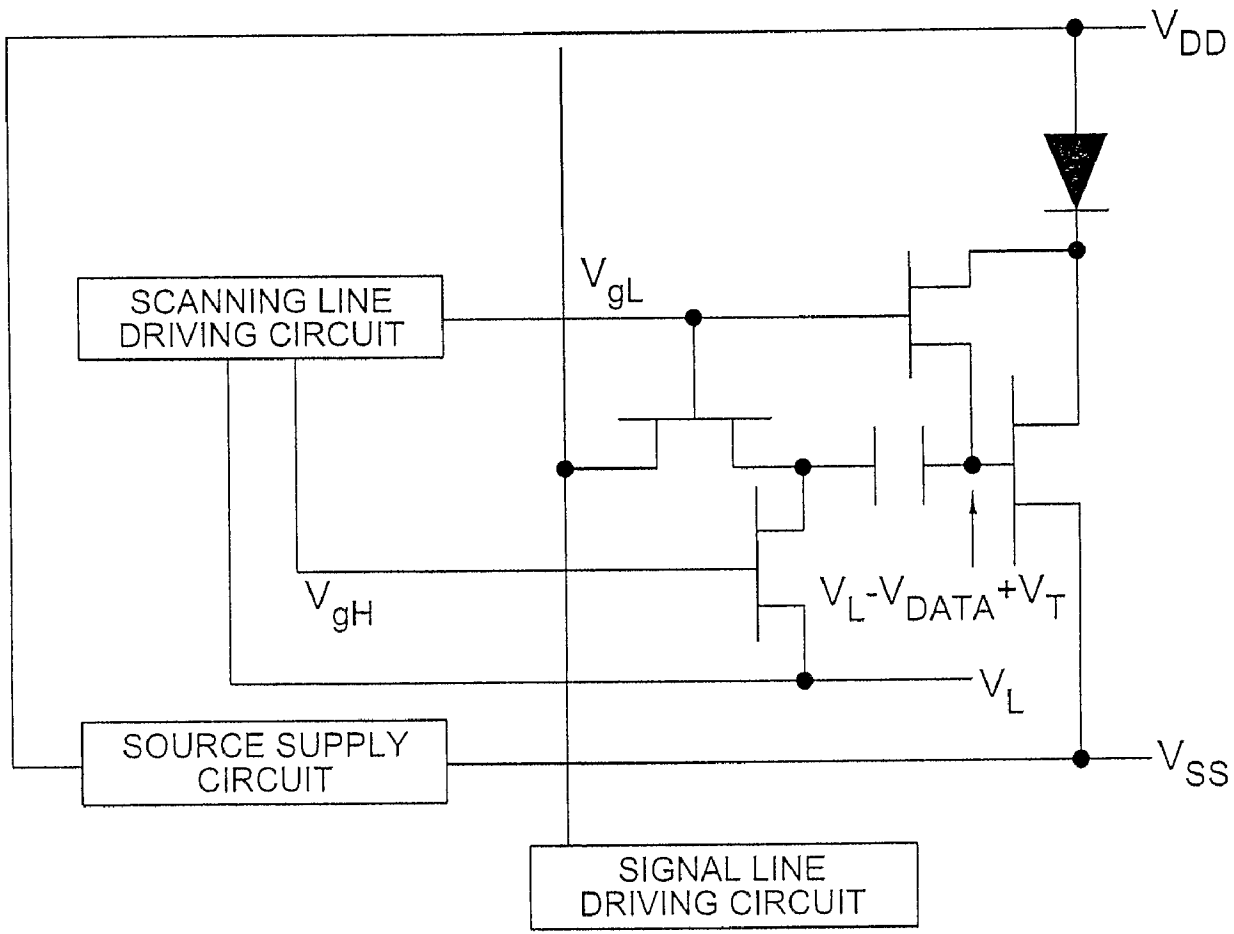
FIG. 15B is a block diagram explaining operations of the pixel circuit shown in FIG. 14.
Figure 15C:
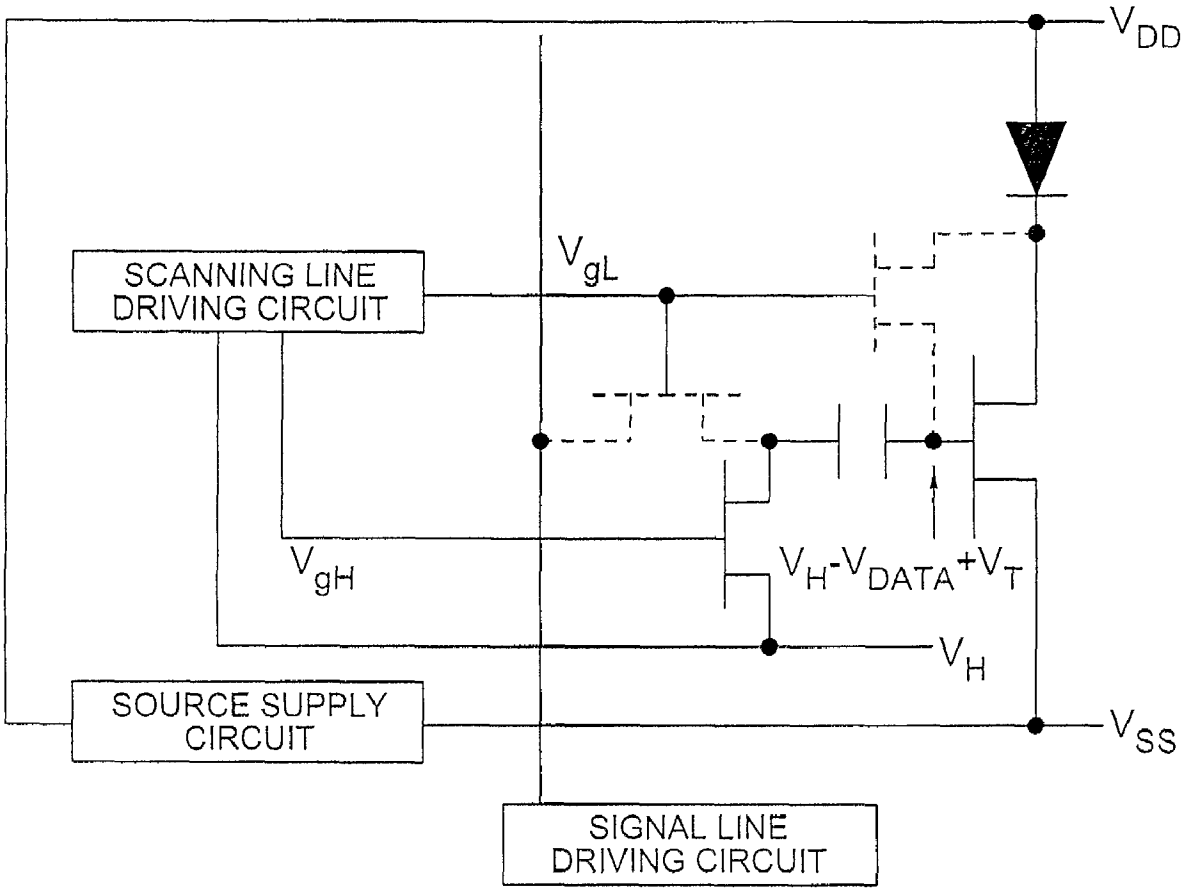
FIG. 15C is a block diagram explaining operations of the pixel circuit shown in FIG. 14.

With this configuration, the switching element 15 and the switching element 21 for short-circuiting are turned on by setting the first scanning line 10 at H level as shown in FIGS. 15A to 15C, a voltage higher by the threshold voltage $V_t$ than the voltage $V_{SS}$ of the negative source line 13 is written in the gate of the driver element 17, and a signal voltage is written in the connection of the switching element 15 with the capacitance 16. Then, after setting the first scanning line 10 at L level, the voltage of the second scanning line is set at a predetermined voltage and the third scanning line 22 is set at H level, then the gate voltage of the driver element 17 can be controlled in the same way as above described as shown in FIG. 16. In this way, $V_t$ compensation is provided by this pixel circuit.

Although in order to provide a complete and clear disclosure the invention has been described with respect to specific embodiments, the appended claims are not to be limited by the illustrated embodiments, but are to be construed as embodying all modifications and alternative constructions that may occur to one skilled in the art which falls within the basic teaching herein set forth.

PARTS LIST

3 driving circuit
4 supply circuit
10 scanning line
11 scanning line
12 source line
13 source line
14 signal lines
15 switching element
16 capacitance
17 driver element
18 light emitting element
19 capacitance
21 switching element
22 scanning line
101 scanning line
102 scanning line
103 signal line
104 driver element
105 light emitting element
106 driving circuit
107 supply circuit
108 driving circuit
109 switching element
110 discharge switch
111 capacitance
201 scanning line
202 scanning line
203 signal line
204 driver element
205 light emitting element
206 driving circuit
207 supply circuit
208 driving circuit
209 switching element
210 switching element
211 capacitance

The invention claimed is:

1. An active matrix-type display device having a pixel circuit for each of a number of pixels arranged in matrix to control the light-emitting period, wherein, each pixel circuit includes:

a light emitting element which emits light in response to a driving current, a driver element for controlling the driving current supplied to the light emitting element, a capacitance in which a signal voltage is written from a signal line for applying a voltage corresponding to the written signal voltage to the gate of the driver element, and a gate potential control line for shifting the potential of the capacitance to control the gate potential of the driver element, wherein, one frame is divided into a plurality of subframes, and in each of the subframes, at least three stages of signal voltage are written in the capacitance from the signal line, and in one subframe, after the signal voltage is written in, the subframe is further divided to form sub-subframes by changing the gate potential of the driver element by the gate potential control line for controlling the gate electrode voltage of the driver element in the sub-subframe by combining the signal voltage and the voltage of the gate potential control line to control a light emitting period of the light emitting element.

2. The active matrix-type display device according to claim 1, wherein connection of the signal line with the capacitance is controlled by a switching element.

3. The active matrix-type display device according to claim 1, wherein the sum of lengths of all subframe periods in each of the subframes is equal to the length of one frame period.

4. The active matrix-type display device according to claim 1, wherein the sub-subframes, in one frame, have a priority light emitting period for a second half sub-subframe in a first half subframe, and a priority light emitting period for a first half sub-subframe in a second half subframe.

5. The active matrix-type display device according to claim 1, wherein the subframes are of equal length.

6. The active matrix-type display device according to claim 1, wherein the driver element is a field effect transistor.

7. The active matrix-type display device according to claim 6, wherein the field effect transistor is a thin film transistor.

8. The active matrix-type display device according to claim 1, wherein the light emitting element is an organic electroluminescent element.

* * * * *